US011105551B2

(12) United States Patent
Kim

(10) Patent No.: US 11,105,551 B2
(45) Date of Patent: Aug. 31, 2021

(54) REFRIGERATOR

(71) Applicant: LG Electronics Inc., Seoul (KR)

(72) Inventor: Jinho Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/843,481

(22) Filed: Apr. 8, 2020

(65) Prior Publication Data

US 2020/0232702 A1 Jul. 23, 2020

Related U.S. Application Data

(63) Continuation of application No. 16/230,902, filed on Dec. 21, 2018, now Pat. No. 10,648,727.

(30) Foreign Application Priority Data

Mar. 30, 2018 (KR) ..... 10-2018-0037249

(51) Int. Cl.

| | |
|---|---|
| ***F25D 25/02*** | (2006.01) |
| ***F25D 23/02*** | (2006.01) |
| *F25D 25/00* | (2006.01) |
| *F25D 25/04* | (2006.01) |

(52) U.S. Cl.

CPC ..... *F25D 25/025* (2013.01); *F25D 23/021* (2013.01); *F25D 25/005* (2013.01); *F25D 25/04* (2013.01)

(58) Field of Classification Search

CPC .... F25D 25/025; F25D 25/005; F25D 23/006; F25D 23/021; F25D 23/069

USPC ..... 312/402, 319.5–319.9

See application file for complete search history.

(56) References Cited

U.S. PATENT DOCUMENTS

| | | | | |
|---|---|---|---|---|
| 8,061,790 | B2 | 11/2011 | Anikhindi et al. | |
| 10,627,156 | B2 * | 4/2020 | Kang | F25D 25/025 |
| 10,648,727 | B2 * | 5/2020 | Kim | F25D 23/021 |
| 2006/0207283 | A1 | 9/2006 | Kim et al. | |
| 2014/0265798 | A1 | 9/2014 | Watts | |

FOREIGN PATENT DOCUMENTS

| | | |
|---|---|---|
| CN | 102155840 | 8/2011 |
| CN | 102226626 | 10/2011 |
| CN | 102483298 | 5/2012 |
| CN | 109990557 | 7/2019 |

OTHER PUBLICATIONS

Chinese Office Action in Chinese Appln. No. 201910157223.1, dated Aug. 26, 2020, 16 pages (with English translation).

* cited by examiner

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator includes a cabinet, a front panel door part, a drawer part located rearward of the front panel door part, and a connection device that is located at the front panel door part, that is configured to couple the front panel door part with the drawer part, and that is configured to transmit power from the front panel door part to the drawer part. The connection device includes an exposed portion that is exposed through the rear surface of the front panel door part and that allows a user to manipulate the connection device, and the connection device is configured to, based on a manipulation of the exposed portion of the connection device by the user, decouple the front panel door part from the drawer part.

20 Claims, 30 Drawing Sheets

REFRIGERATOR

CROSS-REFERENCE TO RELATED APPLICATIONS

The present application is a continuation of U.S. application Ser. No. 16/230,902, filed on Dec. 21, 2018, which claims priority under 35 U.S.C. 119 and 35 U.S.C. 365 to Korean Patent Application No. 10-2018-0037249, filed on Mar. 30, 2018. The disclosures of the prior applications are incorporated by reference in their entirety.

BACKGROUND

The present disclosure relates to a refrigerator.

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to turn its back to take out a basket or foods in the drawer-type door. If the basket or the foods are heavy, the user may feel inconvenient to use the basket or may be injured.

In order to solve such a limitation, various structures are being developed in which the drawer-type door is capable of being elevated.

Representatively, a structure provided with an elevatable storage container on a rear surface of a withdrawable door is disclosed in Korean Patent Publication No. 10-2008-0101335. However, in this structure, a connection portion between the door and the storage container may be exposed, and electrical devices and structures for the elevation may be exposed to cause serious problems of safety in use.

Also, a structure in which a basket is elevated by an operation of a support member provided on a door is disclosed in Korean Patent Publication No. 10-2006-0053420. In this structure, a support member is exposed directly from a rear surface and a bottom surface of the door to cause problems in safety in use.

As described above, in the related art, the constituents for elevating on the door side are disposed in an exposed state, which results in poor appearance and a safety limitation.

Also, there is a limitation that it is difficult to separate and install the structure for elevating the basket in which the food is accommodated, making service and cleaning management difficult.

Also, the basket having a structure in which substantially the entire basket is elevated during operation of the elevation structure. In this structure, when the food inside the basket is eccentric, it is difficult for the basket to vertically move stably due to the eccentric load. In addition, the basket may be severely deformed and damaged.

Also, the entire basket for elevation is withdrawn to the outside of the refrigerator body so that a draw-out distance is relatively long, and the structure for elevating the basket is additionally disposed on the door to be unstable when the door is withdrawn, there is a limitation of deformation and breakage of the door and the constituents for inserting and withdrawing the door.

SUMMARY

Embodiments provide a refrigerator in which a portion of a door, which is withdrawn in a drawer type, is elevatable to improve convenience in use.

Embodiments also provide a refrigerator in which a portion of a door, which is withdrawn in a drawer type, is elevatable and constituents for elevation are prevented from being exposed to the outside.

Embodiments also provide a refrigerator in which a front panel door part and a drawer part of a drawer-type door which is inserted and withdrawn in a drawer type and of which a portion is elevatable are separable from each other, and a driving device and an elevation device are separated from each other when the front panel door part and the drawer part are separated from each other.

Embodiments also provide a refrigerator in which constituents for elevation are separated from and coupled to each other together when a front panel door part and a drawer part are separated from and closed to each other through simple manipulation without using a separate mechanism.

Embodiments also provide a refrigerator in which a driving device and an elevation device, which are disposed to be spaced apart from each other, are capable of selectively receiving power through coupling and separation of a connection device and a power transmission member.

Embodiments also provide a refrigerator in which a portion of constituents within a drawer part is elevatable in a stable state without being tilted to one side.

Embodiments also provide a refrigerator in which a drawer door of a withdrawable drawer door is elevated in a state of being completely withdrawn to the outside of a cabinet to improve safety and durability in operation.

In an embodiment, a refrigerator includes a door opening and closing a storage space through insertion and withdrawal thereof and constituted by a front panel door part and a drawer part; and a support member elevated by an elevation device inside the drawer part.

The support member may be disposed in a front part within the drawer part.

According to one aspect of the subject matter described in this application, a refrigerator includes: a cabinet that defines an upper storage space and a lower storage space; a front panel door part configured to open and close at least a portion of the lower storage space; a drawer part located rearward of a rear surface of the front panel door part and configured to insert into and withdraw from the lower storage space together with the front panel door part; and a connection device that is located at the front panel door part, that is configured to couple the front panel door part with the drawer part, and that is configured to transmit power from the front panel door part to the drawer part in a state in which the front panel door part is coupled with the drawer part. The connection device includes an exposed portion that is exposed through the rear surface of the front panel door part and that allows a user to manipulate the connection device, and the connection device is configured to, based on a manipulation of the exposed portion of the connection device by the user, decouple the front panel door part from the drawer part.

Implementations according to this aspect may include one or more of the following features. For example, the rear surface of the front panel door part may define a recess part, and the connection device is accommodated in the recess part of the rear surface of the front panel door part. In some examples, the front panel door part includes a door cover configured to cover the recess part of the rear surface of the front panel door part. In some examples, the rear surface of the front panel door part defines an opening through which the exposed portion of the connection device is exposed for manipulation by the user.

In some implementations, the refrigerator further includes: a drawer-side device located at the drawer part and configured to elevate an object stored in the drawer part relative to the drawer part; and a door-side device located at the front panel door part and configured to provide power to the drawer-side device for operation of the drawer-side device. In some examples, the connection device further includes: a connection device case located at the front panel door part; a second connection gear accommodated in the connection device case and configured to be gear-coupled to a first connection gear in the door-side device, the second connection gear being configured to rotate about an axis of the second connection gear; a first connection member that is configured to connect to the second connection gear along a direction of the axis of the second connection gear, that is configured to rotate together with the second connection gear, and that is configured to selectively couple the door-side device with the drawer-side device to transmit power to the drawer-side device; and an elastic member configured to support the second connection gear and the first connection member. The first connection member may be further configured to: compress the elastic member based on insertion of the first connection member into the connection device case; and disconnect from the drawer-side device in a state in which the first connection member and the second connection gear are inserted into the connection device case.

In some examples, the exposed portion of the connection device includes a push member that is exposed through the rear surface of the front panel door part and that is configured to be manipulated by the user, where the push member is connected to the first connection member and configured to move together with the first connection member based on the push member being manipulated by the user. In some examples, the push member includes: a through-hole that is defined at a side of the push member facing the drawer part and that is configured to receive the first connection member; and a push part that protrudes toward the drawer part and that is configured to be manipulated by the user.

In some implementations, the connection device further includes a coupling member that is configured to connect the second connection gear to a rotation center of the first connection member and that allows the second connection gear and the first connection member to rotate together with each other, where the first connection member defines an insertion hole configured to receive the coupling member, the first connection member being configured move along the coupling member based on the coupling member passing through the insertion hole. The elastic member may be located between the second connection gear and the first connection member.

In some examples, the connection device further includes a first connection part configured to connect to the drawer-side device and located at an end of the first connection member facing the insertion hole, where an inside of the first connection part is configured to couple to an end of the drawer-side device, the inside of the first connection part having a shape corresponding to a shape of the end of the drawer-side device. The first connection part may be configured to transfer power based on the inside of the first connection part coupling to the end of the drawer-side device.

In some implementations, the refrigerator further includes: a support member located in the drawer part and configured to support an object stored in the drawer part; at least one elevation device that is located at each of a first side and a second side of the drawer part, that is configured to couple to each of a first end and a second end of the support member, and that is configured to elevate the support member relative to the drawer part; at least one power transmission member that is located at each of the first side and the second side of the drawer part, that extends from a front surface of the drawer part toward the front panel door part, and that is configured to connect to the at least one elevation device, the at least one power transmission member being configured to transmit power to the at least one elevation device; and a driving device located at the front panel door part and configured to provide power for operation of the at least one elevation device. The connection device may be configured to couple the driving device with the at least one power transmission member, and to transmit power from the driving device to the at least one power transmission member. The connection device may be configured to, based on the manipulation of the exposed portion of the connection device, decouple from the at least one power transmission member.

In some examples, an end of the at least one power transmission member is located at each of a first side and a second side of the front surface of the drawer part, where the connection device is arranged to face the at least one power transmission member, and configured to couple with the at least one power transmission member in a state in which the front panel door part and the drawer part are coupled to each other. In some examples, each of the at least one elevation device includes: a rail housing located at an inner surface of the drawer part; an elevation shaft located in the rail housing and configured to be rotated by power that is transmitted from the driving device; and a block holder that defines an opening configured to be penetrated by the elevation shaft, that is coupled to the elevation shaft, and that is configured to move longitudinally along the elevation shaft. The block holder may be configured to be coupled to the support member.

In some examples, each of the at least one power transmission member includes: a drawer shaft located at the first side or the second side of the drawer part; a transmission gear that is located at a first end of the drawer shaft, that is configured to couple to a shaft gear located at the elevation shaft, and that is configured to cause rotation of the elevation shaft; and a second connection member that is located at a second end of the drawer shaft, that is configured to couple to the connection device to allow the second connection member and the drawer shaft to rotate together with each other.

In some examples, the drawer part defines: a front space disposed forward in a direction in which the drawer part is configured to withdraw from the lower storage space; and a rear space disposed rearward of the front space, where the support member and the elevation device are arranged in the front space. In some examples, the drawer part is configured to withdraw from the lower storage space in a state in which at least a portion of the rear space of the drawer part remains inside of the lower storage space.

In some implementations, the driving device includes: a motor assembly located at the rear surface of the front panel door part; a driving shaft configured to pass through the motor assembly and to be rotated by the motor assembly; and at least one first connection gear located at each of a first end and a second end of the driving shaft, where the connection device is configured to gear-couple with the at least one first connection gear at the first end and the second end of the driving shaft.

In some examples, the connection device includes: a connection device case located at the front panel door part; a second connection gear accommodated in the connection device case and configured to be gear-coupled to the first connection gear, with an axis of the second connection gear crossing an axis of the first connection gear; a first connection member that is configured to move to an inside of the connection device case based on a user manipulation of the connection device, and that is configured to selectively connect to the at least one power transmission member based on moving to the inside of the connection device case; an elastic member configured to support the second connection gear and the first connection member; and a push member that is connected to the first connection member. The push member may include an exposed portion that is exposed through the rear surface of the front panel door part and that allows the user to manipulate the push member to cause the first connection member to move to the inside of the connection device case.

In some implementations, the driving device and the at least one power transmission member are configured to be gear-coupled to each other by gears that are configured to transmit power from a first direction to a second direction crossing the first direction, where the power transmission member and the elevation device are coupled to each other by gears that are configured to transmit power from a third direction to a fourth direction crossing the third direction.

In some implementations, the front panel door part includes a door frame that is configured to couple to each of the first side and the second side of the drawer part and that enables the drawer part to insert into and withdraw from the lower storage space together with the front panel door part, where the connection device is configured to, based on the manipulation of the exposed portion of the connection device, decouple the front panel door part from the drawer part by decoupling the door frame from the drawer part.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
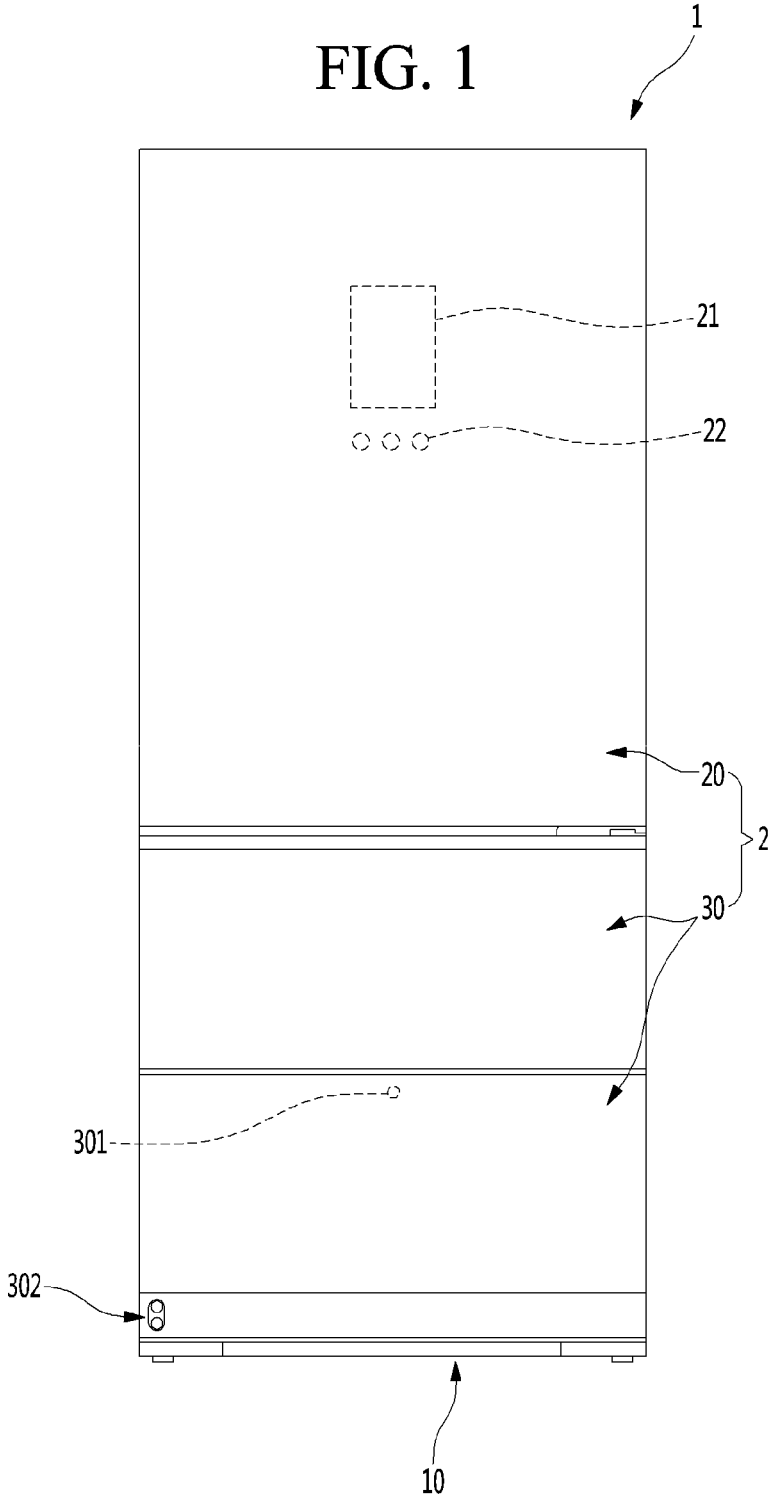
FIG. 1 is a front view of a refrigerator according to an embodiment.
Figure 2:
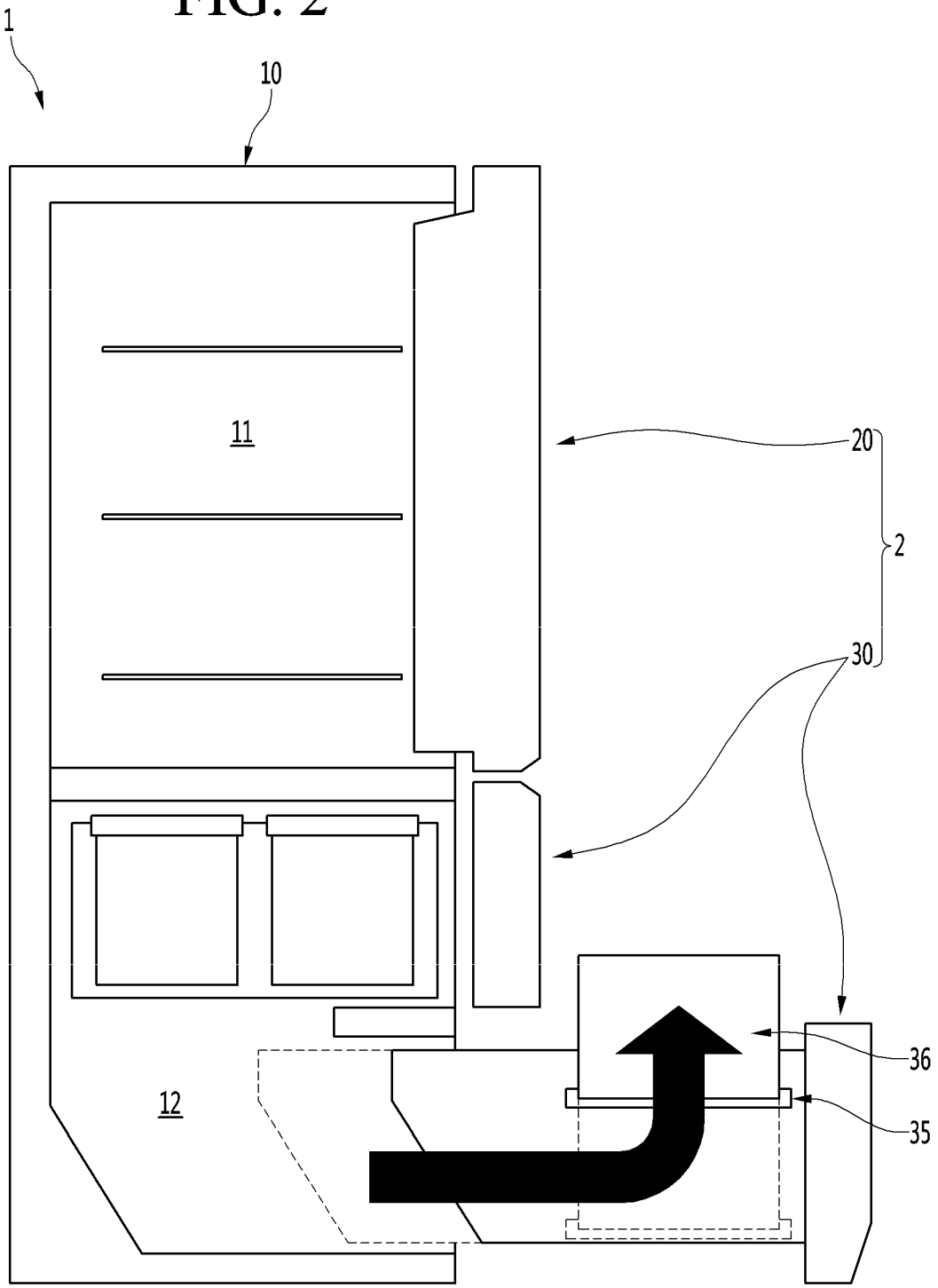
FIG. 2 is a schematic view illustrating a state in which a drawer door of the refrigerator is inserted and withdrawn and is elevated.

FIG. 1 is a front view of a refrigerator according to an embodiment. Also, FIG. 2 is a schematic view illustrating a state in which a drawer door of the refrigerator is inserted and withdrawn and is elevated.

As illustrated in the drawing, the refrigerator 1 may have an outer appearance that is defined by a cabinet 10 defining a storage space and a door 2 covering an opened front surface of the cabinet 10.

The storage space of the cabinet 10 may be divided into a plurality of spaces. For example, an upper space of the cabinet 10 may be provided as a refrigerating compartment 11, and a lower space of the cabinet 10 may be provided as a freezing compartment 12. Each of the upper space and the lower space may be provided as an independent space that is maintained at a different temperature, except for the refrigerating compartment and the freezing compartment. The upper space and the lower space may be called an upper storage space 11 and a lower storage space 12.

The door 2 may be constituted by a rotation door 20 opening and closing the upper space through rotation thereof and a drawer door 30 opening and closing the lower space by being inserted or withdrawn in a drawer type. The lower space may be vertically divided again. The drawer door 30 may be constituted by an upper drawer door 30 and a lower drawer door 30. Also, an outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type.

A display 21 may be disposed on one side of a front surface of the rotation door 20. The display 21 may have a liquid crystal display structure or a multi-segment display such as a seven-segment display or an "88" shape segment structure. Also, when the outer appearance of the door 2 is made of the metal material, a plurality of fine holes are punched in the display 21 to display information by using light passing therethrough.

Also, a manipulation part 22 that is capable of manipulating automatic rotation or withdrawal of the upper door 2 or the lower door 2 may be provided on one side of the rotation door 20. The manipulation part 22 may be integrated with the display 21 and may operate in a touch manner or a button manner. The manipulation part 22 may input an overall operation of the refrigerator 1 and manipulate an insertion and withdrawal of the drawer door 30 or an elevation of a support member 35 within the drawer door.

A manipulation part 301 may also be provided on the drawer door 30. The manipulation part 301 may be disposed on one side of the drawer door 30 that is disposed at the lowermost portion of the drawer door 30. The manipulation part 301 may operate in a touch or button manner. The manipulation part 301 may be provided as a sensor detecting proximity or movement of a user or provided as an input unit that operates by a user's motion or voice.

As illustrated in the drawing, a manipulation device 302 may be disposed on a lower end of the lower drawer door 30 to illuminate an image on a bottom surface and thereby to output a virtual switch and to input an operation in such a manner that the user approaches a corresponding area.

The lower drawer door 30 may be automatically inserted and withdrawn according to the manipulation of the manipulation part 301. Also, a food or container 36 within the lower drawer door 30 may be elevated in a state in which the drawer door 30 is withdrawn by the manipulation of the manipulation part 301.

That is, the automatic insertion and withdrawal and/or automatic elevation of the lower drawer door 30 may be performed by at least one of a plurality of manipulation devices 22, 301, and 302. As necessary, only one of the plurality of manipulation devices 22, 301, and 302 may be provided.

Hereinafter, the lower drawer door 30 will be described in more detail, and also, the lower drawer door 30 will be called a drawer door unless otherwise specified.

Figure 3:
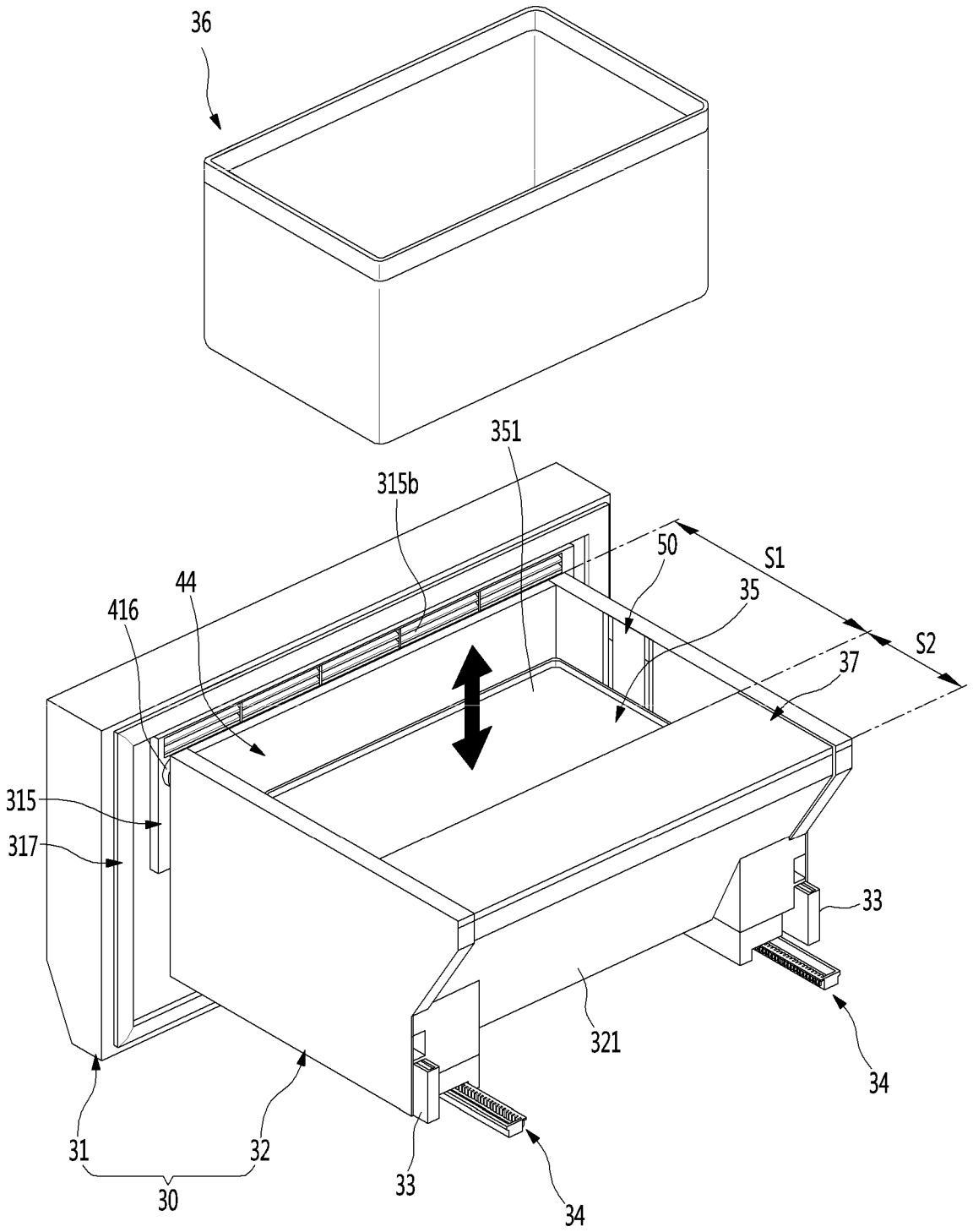
FIG. 3 is a perspective view illustrating a state in which a container of the drawer door is separated.
Figure 4:
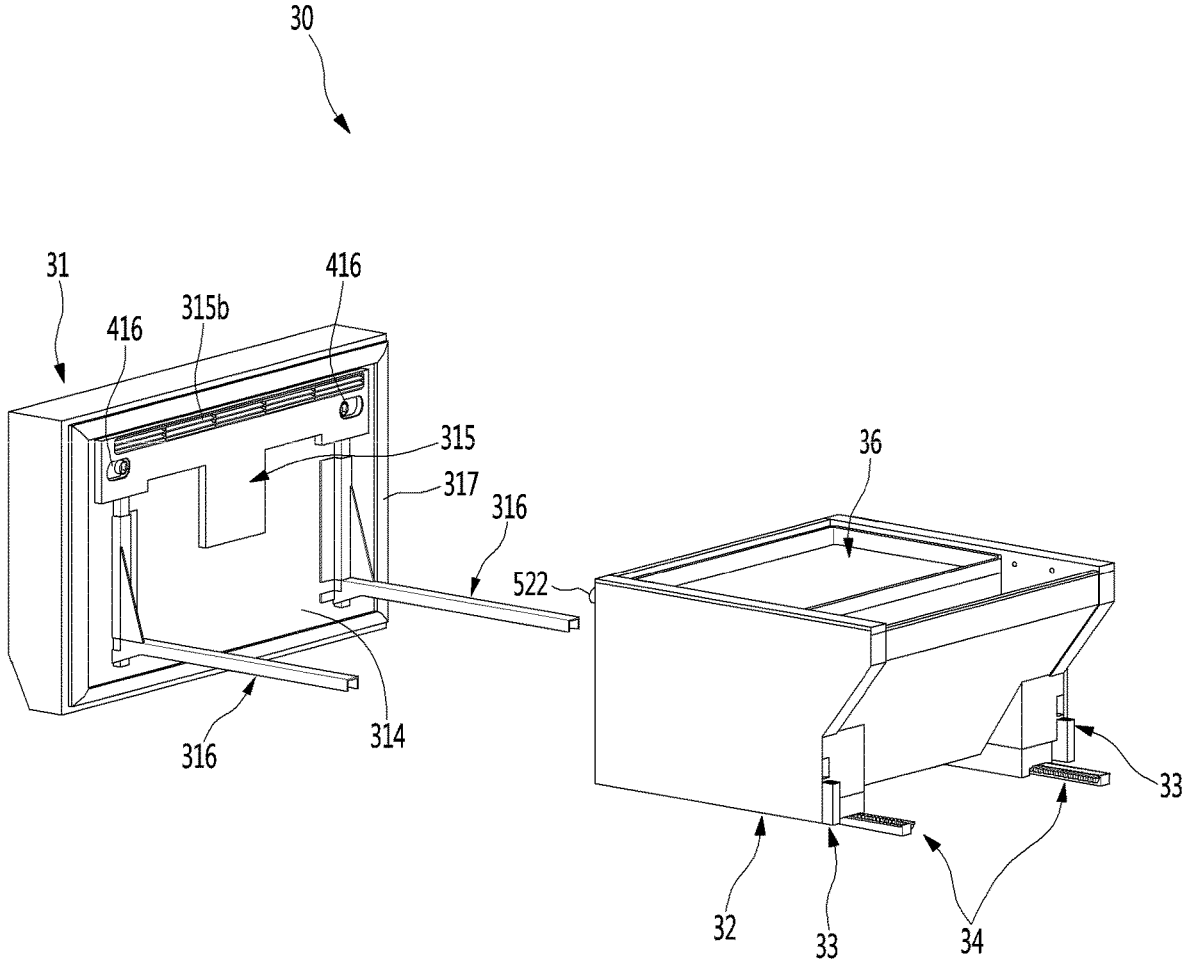
FIG. 4 is an exploded perspective view of the drawer door.

FIG. 3 is a perspective view illustrating a state in which the container of the drawer door is separated. Also, FIG. 4 is an exploded perspective view of the drawer door.

As illustrated in the drawings, the drawer door 30 may include a front panel door part 31 opening and closing the storage space and a drawer part 32 coupled to a rear surface of the front panel door part 31 and inserted and withdrawn together with the front panel door part 31.

The front panel door part 31 may be exposed to the outside of the cabinet 10 to define an outer appearance of the refrigerator 1, and the drawer part 32 may be disposed inside the cabinet 10 to define an storage space. Also, the front panel door part 31 and the drawer part 32 may be coupled to each other and inserted and withdrawn forward and backward together with each other.

The drawer part 32 may be disposed on the rear surface of the front panel door part 31 to define a space in which the food or container 36 to be stored is accommodated. The inside of the drawer part 32 may have a box shape having an opened top surface to define the accommodation space therein.

The drawer part 32 may be constituted by both left and right surface parts for mounting of the elevation device 51 and a bottom surface part connecting both the left and right surface parts to each other to define a bottom surface and also may selectively include a front surface part and a rear surface part.

An outer appearance of the drawer part 32 may be defined by a plurality of plates 391, 392, and 395. Each of the plurality of plates 391, 392, and 395 may be made of a metal material and provided inside and outside the drawer part 32 so that the entire drawer part 32 is made of stainless steel or a material having a texture such as stainless steel.

In the state in which the drawer door 30 is inserted, a machine room 3 in which a compressor and a condenser constituting a refrigeration cycle are provided may be disposed behind the drawer door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the drawer door 30 may be provided on each of both side surfaces of the drawer part 32. The drawer door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multistage.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided on the bottom surface of the drawer part 32 and called an under rail. The draw-out rail may be disposed on a lower portion or the bottom surface of the drawer part to prevent the draw-out rail from interfering with the elevation device 51 and secure independent operations of the draw-out rail 33 and the elevation device 51.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the drawer door 30. That is, when an operation is inputted into the manipulation parts 22 and 301, the draw-out motor 14 may be driven to insert and withdraw the drawer door 30 according to movement of the draw-out rack 34. Here, the drawer door 30 may be stably inserted and withdrawn by the draw-out rail 33.

The draw-out rack 34 may not be provided on the drawer part 32. Here, the user may hold a side of the front panel door part 31 to push and pull the front panel door part 31 so that the drawer door 30 is directly inserted and withdrawn.

The inside of the drawer part 32 may be divided into a front space S1 and a rear space S2. The support member 35 that is vertically elevated and a container seated on the support member 35 to be elevated together with the support member 35 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

Also, when the drawer door 30 is withdrawn, the entire drawer part 32 may not be withdrawn to the outside of the storage space due to a limitation in draw-out distance of the drawer door 30. That is, at least the front space S1 is withdrawn to the outside of the storage space, and the whole or a portion of the rear space S2 is disposed inside the storage space within the cabinet 10, i.e., in the lower storage space.

The draw-out distance of the drawer door may be limited by the draw-out rack 34 or the draw-out rail 33. Also, when compared with a draw-out distance of the general drawer door 30 in which the drawer part 32 is completely withdrawn, the draw-out distance according to this embodiment may be relatively short. Thus, when compared with a case in which the drawer part 32 is completely withdrawn to the outside of the lower storage space, acting moment may be reduced to prevent the draw-out rail 33 or the draw-out rack 34 from being deformed or damaged by a load of the drawer door.

The support member 35 is accommodated in the front space S1. The support member 35 may be elevated together with the food or container 36 seated on the support member 35 inside the drawer part 32. Also, constituents for the elevation of the support member 35 may be disposed on both left and right surfaces of the drawer part 32 and coupled to a central point of both side surfaces of the support member 35 to fix the support member 35 to be elevated without allowing the support member to be lean to one side.

A separate drawer cover 37 may be provided in the rear space S2. The front space S1 and the rear space S2 may be partitioned by the drawer cover 37. In a state in which the drawer cover 37 is mounted, front and top surfaces of the rear space S2 may be covered.

Thus, the food or container 36 accommodated in the support member 35 that is elevated in the front space S1 may be prevented from dropping into the rear space. Particularly, in the elevation process, the food or container 36 seated on the support member 35 may be prevented from being separated from the front space S1.

When the drawer cover 37 is separated, the user may be accessible to the rear space S2, and thus, foods may be easily accommodated in the rear space S2. To utilize the rear space S2, a separate structure for accommodating may be provided in the rear space S2.

As illustrated in the drawings, the front panel door part 31 and the drawer part 32 constituting the drawer door 30 may be coupled to be separated from each other. Thus, assembling workability and serviceability may be improved through the separable structure of the front panel door part 31 and the drawer part 32.

A rear surface of the front panel door part 31 and a front surface of the drawer part 32 may be coupled to each other. When the front panel door part 31 and the drawer part 32 are coupled to each other, power for the elevation of the support member 35 may be provided. The elevation assembly (see reference numeral 40 of FIG. 9) for the elevation of the support member 35 may be disposed on each of the front panel door part 31 and the drawer part 32. When the front panel door part 31 and the drawer part 32 are coupled to or separated from each other, the elevation assembly may be selectively connected.

For this, the elevation assembly 40 may include a driving device (see reference numeral 41 of FIG. 8) provided in the front panel door part 31 and a drawer-side device (see reference numeral 50 of FIG. 8) provided in the drawer part 32. The driving device 41 may be provided in the front panel door part 31, and a connection device 60 that is one component of the driving device 41 may be exposed to the rear surface of the front panel door part 31. Also, the drawer-side device 50 may be provided in the drawer part 32, and a second connection member 522 disposed at a position corresponding to the connection device 60 may be exposed to the front surface of the drawer part 32. The connection device 60 and the second connection member 522 may have shapes corresponding to each other and be coupled to be separated from each other. When the connection device 60 and the second connection member 522 are coupled to each other, power may be transmitted. When the front panel door part 31 is fixed to the drawer part 32, the door connection member 416 and the drawer connection member 522 may be coupled to each other. When the front panel door part 31 is separated from the drawer part 32, the front panel door part 31 and the drawer part 32 may be separated from each other.

That is, a protrusion and a groove may be provided on the connection device 60 and the second connection member 522, respectively. The protrusion and the groove may have a polygonal shape or a shape that is capable of transmitting the power and be interlocked with each other. The connection device 60 and the second connection member 522 may have a different coupling structure in which the power is capable of being transmitted and detachable.

The door cover 315 may be disposed on the rear surface of the front panel door part 31. The door cover 315 may be assembled to be mounted so that the driving device 41 is covered after the driving device 41 is mounted behind the front panel door part 31. The door cover 315 may be configured to cover the entire rear surface of the front panel door part 31 or cover only an area corresponding to the driving device 41.

Also, a pair of door frames 316 may be disposed on the rear surface of the door 2. The coupled state of the front panel door part 31 and the drawer part 32 may be maintained by the door frames 316.

Hereinafter, the front panel door part 31 and the drawer part 32 constituting the drawer door 30 will be described in more detail with reference to the drawings.

Figure 5:
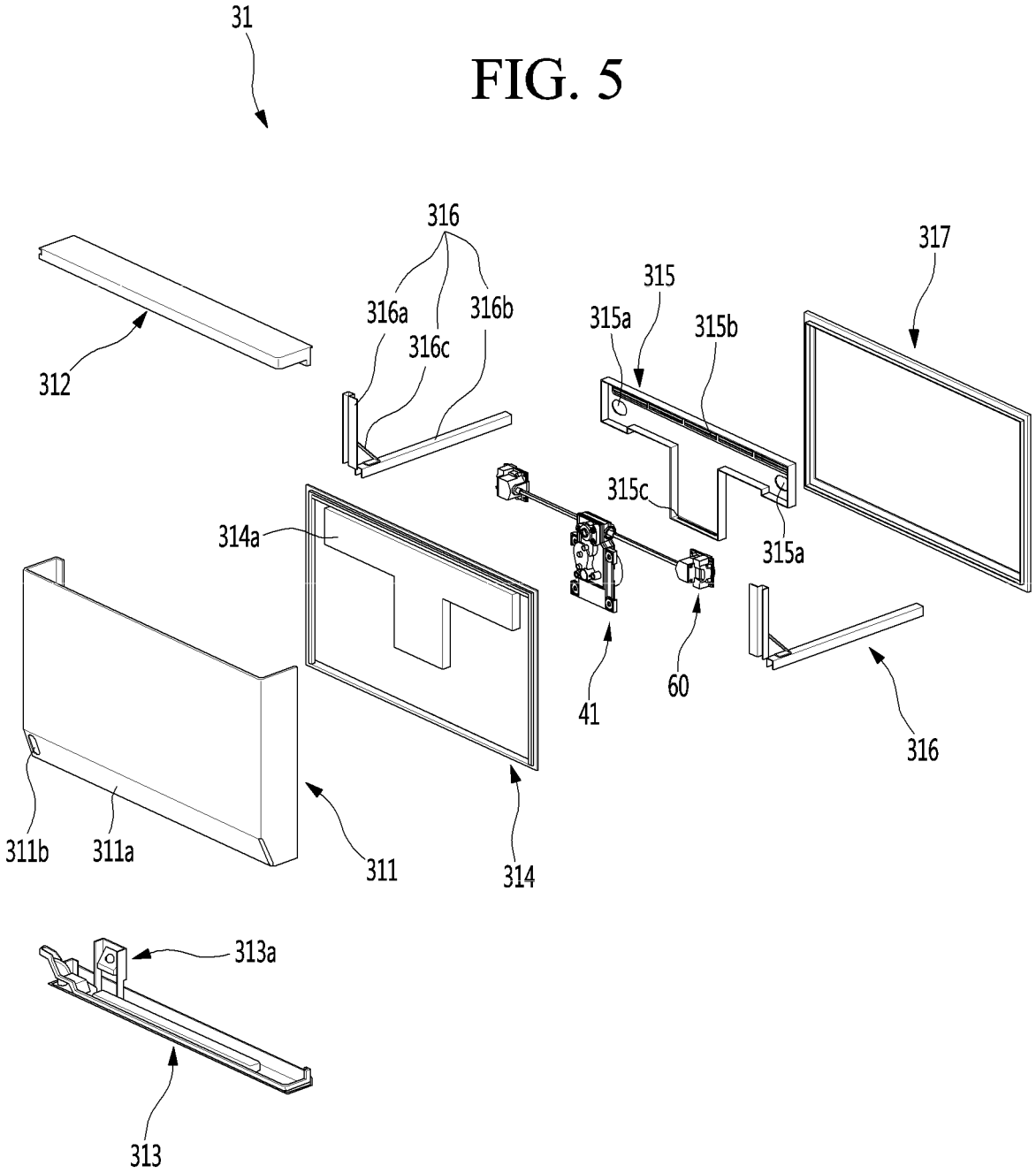
FIG. 5 is an exploded perspective view illustrating a front panel door part of the drawer door.
Figure 6:
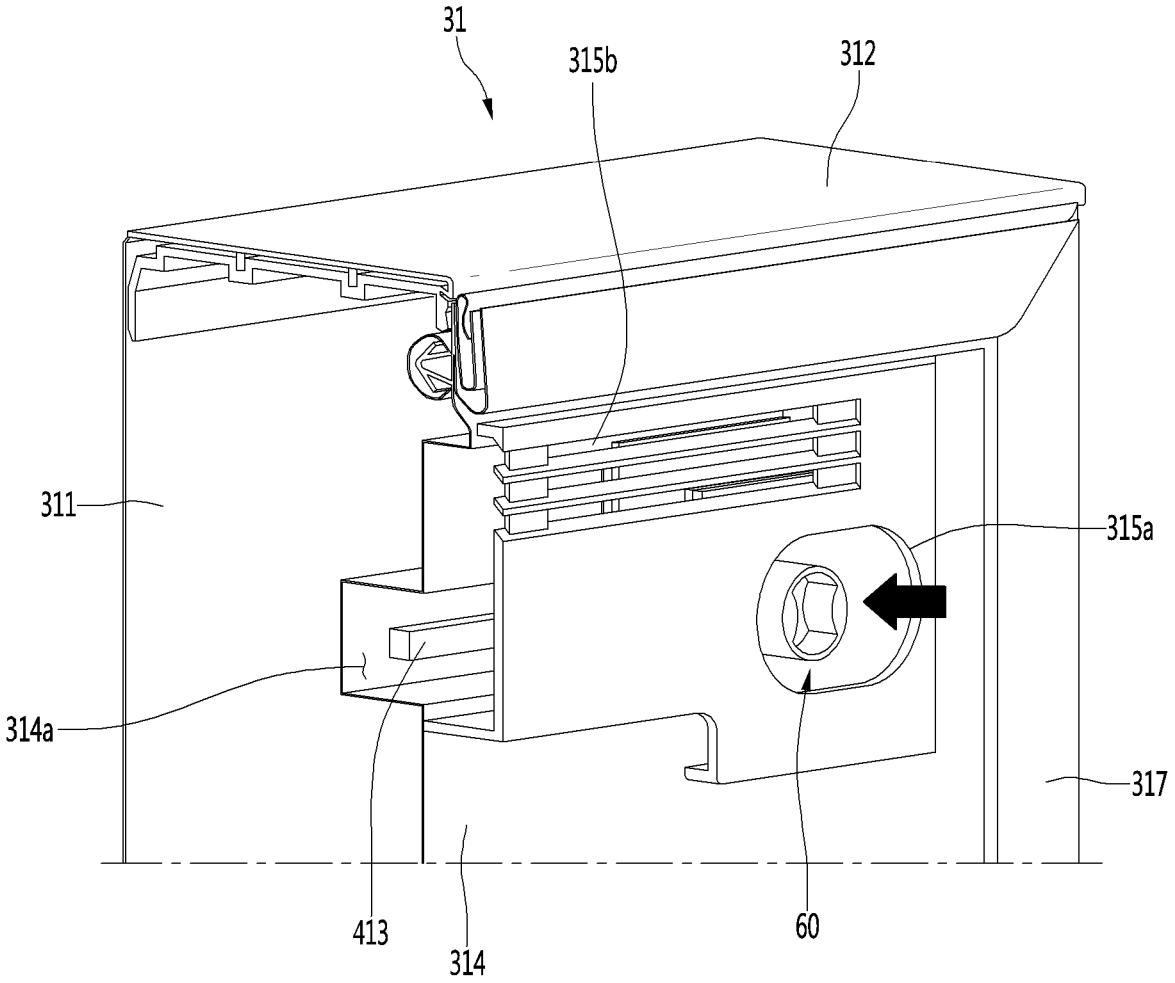
FIG. 6 is a partial cutaway perspective view of the front panel door part.

FIG. 5 is an exploded perspective view illustrating the front panel door part of the drawer door. Also, FIG. 6 is a partial cutaway perspective view of the front panel door part.

As illustrated in the drawings, the front panel door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, an insulation material may be filled into the front panel door part 31.

The outer case 311 may be formed by bending a plate-shaped metal material, and an inclined part 311*a* may be provided on a lower end of a front surface of the outer case 311. A manipulation device hole 311*b* is defined in one side of the inclined part 311*a*, and the manipulation device 302 for detecting an output of a virtual switch and user's manipulation may be disposed in the manipulation device hole 311*b*. The manipulation device 302 may be constituted by a projector light that outputs an image to be used as a virtual switch and a proximity sensor.

A manipulation part bracket 313*a* for the mounting of the manipulation device 302 and an arrangement of a line connected to electrical components within the front panel door part 31 may be provided in the lower deco 313.

The door liner 314 may be injection-molded by using a plastic material to define the rear surface of the front panel door part 31. Also, the door liner 314 may have a recess part 314*a* in which the driving device 41 is mounted. The door cover 315 may be mounted on the door liner 314 to cover the driving device 41 mounted on the front panel door part 31 and the recess part 314*a*.

A cold air inflow hole 315*b* may be defined in an upper portion of the door cover 315. At least a portion of the cold air inflow hole 315*b* may be exposed at a height higher than that of the upper end of the drawer part 32 when the front panel door part 31 and the drawer part 32 are coupled to each other. Thus, a portion of cold air supplied to the drawer part 32 may be introduced into the door cover 315 through the cold air inflow hole 315*b*. Also, a cold air discharge hole 315*c* may be defined in a lower portion of the door cover 315. The cold air discharge hole 315*c* is opened downward between the front panel door part 31 and the drawer part 32. Thus, the cold air introduced into the door cover 315 may flow up to a lower side of the drawer part 32.

That is, the door cover 315 may provide a flow and circulating path of the cold air at the front of the drawer part 32 therein. In a state in which the drawer part 32 is inserted into the storage space of the cabinet 10, the cold air may circulate around the drawer part 32 to more efficiently cool the drawer part 32.

Also, a connection device hole 315*a* may be defined in the rear surface of the front panel door part 31. The connection device hole 315*a* may be defined in the door cover 315. The connection device 60 may be exposed to the rear surface of the front panel door part 31 through the connection device hole 315*a*. The connection device 60 may move forward and backward according to the user's manipulation. When the front panel door part 31 and the drawer part 32 are separated from each other by the user's manipulation, the connection device 60 and the power transmission member 52 may be separated from each other.

The driving device 41 may be provided on the front panel door part 31. The driving device 41 may be constitutes disposed in the front panel door part 31 of the elevation assembly 40 and may be called a door-side device. The driving device 41 may include the motor assembly 412 configured to provide power and the door-side shaft 413 passing through the motor assembly 412. Also, the driving device 41 may further include the connection device 60. A configuration of each of the constituents of the driving device 41 will be described below in more detail.

Also, the motor assembly 412 may be disposed in parallel to the front surface of the front panel door part 31 to minimize a recessed depth of the inside of the front panel door part 31, thereby securing insulation performance.

The pair of door frames 316 may be disposed on both left and right sides on the rear surface of the front panel door part 31. The door frames 316 may connect the front panel door part 31 to the drawer part 32 so that the drawer part 32 is maintained in the state of being coupled to the front panel door part 31.

In detail, the door frames 316 may be constituted by a door frame part 316*a* fixed to the rear surface of the front panel door part 31 and a drawer frame part 316*b* fixed to the bottom surface of the drawer part 32. The door frame part 316*a* and the drawer frame part 316*b* may be vertically perpendicular to each other. Also, a frame reinforcement part 316*c* connecting the door frame part 316*a* to the drawer frame part 316*b* to prevent the door frames 316 from being deformed may be further provided.

The door frame part 316*a* may be mounted on the rear surface of the front panel door part 31 and provided in the front panel door part 31 so that the drawer frame part 316*b* extends to pass through the rear surface of the front panel door part 31. Also, the drawer frame part 316*b* may extend backward from a lower end of the door frame part 316*a* to support the drawer part 32 at a lower side.

Also, a gasket 317 contacting the front end of the cabinet 10 to seal the storage space may be disposed around the rear surface of the door liner 314.

Figure 7:
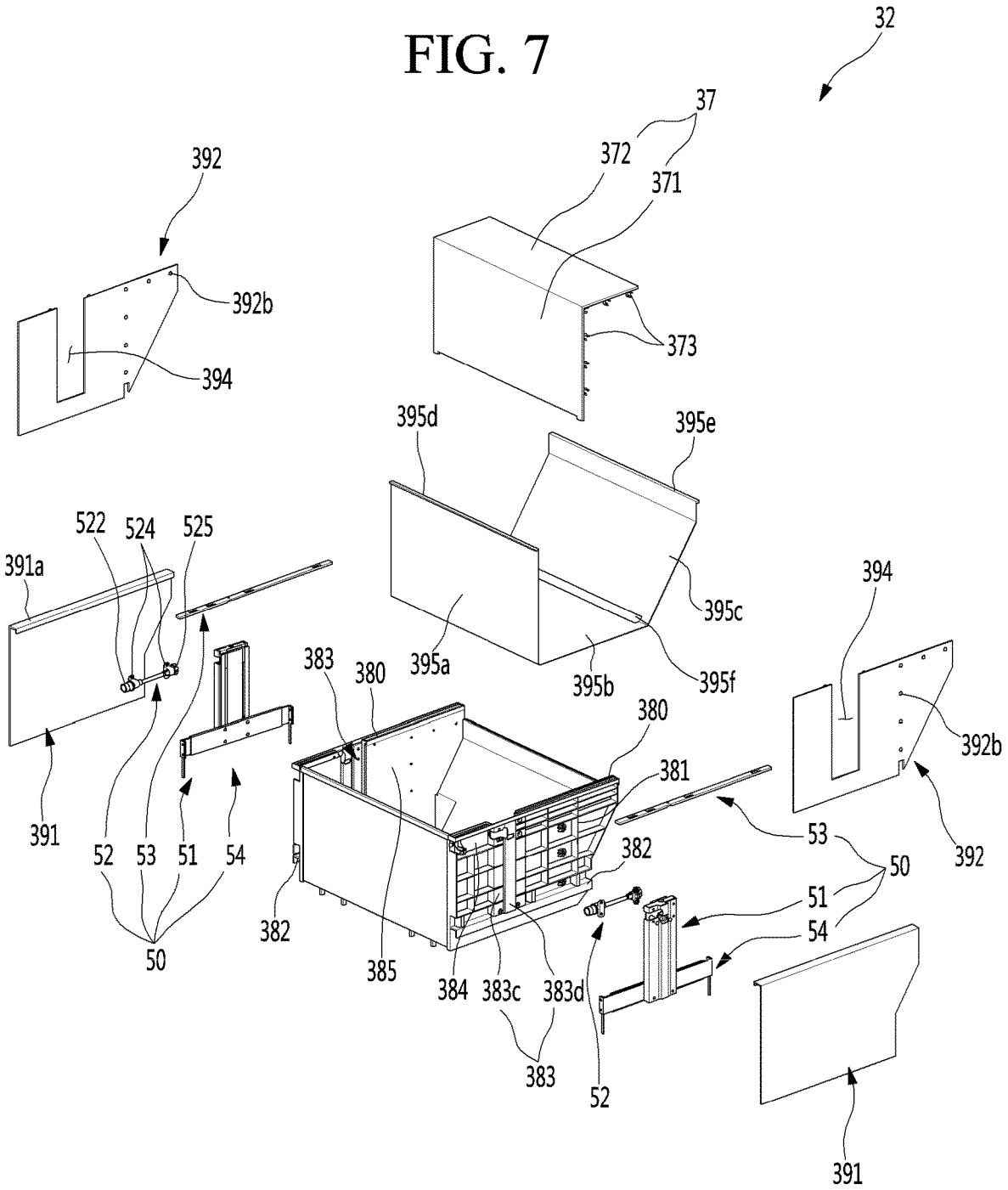
FIG. 7 is an exploded perspective view illustrating a drawer part of the drawer door.

FIG. 7 is an exploded perspective view illustrating the drawer part of the drawer door.

As illustrated in the drawings, the drawer part 32 may include a drawer body 38 defining an entire shape of the drawer part 32, a drawer-side device 50 provided in the drawer body 38 to constitute the elevation assembly 40, and a plurality of plates 391, 392, and 393 defining an outer appearance of the drawer part 32.

In more detail, the drawer body 38 may be injection-molded by using a plastic material and define an entire shape of the drawer part 32. The drawer body 38 may have a basket shape having an opened top surface to define a food storage space therein. An inclined surface 321 may be disposed on a rear surface of the drawer body 38. Thus, an interference with the machine room 3 may not occur.

The door frames 316 may be mounted on both sides of the drawer part 32. The door frame 316 may be coupled to a lower portion of each of both sides of the bottom surface or both left and right surfaces of the drawer part 32. The drawer part 32 and the front panel door part 31 may be integrally coupled to each other and be inserted and withdrawn together with each other.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion of the rear space S2 is disposed in the lower storage space.

Also, the draw-out rack 34 may be coupled to a pinion gear 141 disposed on the bottom surface of the storage space. Thus, when the draw-out motor (see reference numeral 14 of FIG. 26) is driven, the pinion gear (see reference numeral 141 of FIG. 26) may rotate to allow the draw-out rack 34 to move, and the drawer door 30 may be inserted and withdrawn.

The drawer door 30 may not be automatically inserted and withdrawn. That is, the user may push or pull the drawer door 30 to be inserted and withdrawn. Here, the draw-out rack 34 may be omitted, and thus, the insertion and withdrawal may be performed through only the draw-out rail 33.

A plurality of reinforcement ribs 381 may extend in vertical and horizontal directions on both left and right sides of the drawer body 38. The reinforcement ribs 381 may prevent the drawer body 38 from being deformed by a load applied to both the left and right surfaces of the drawer body.

Particularly, the elevation device 51, which is a main component for the elevation of the support member 35, may be disposed on both side surfaces of the drawer body 38. Thus, when the support member 35 and the food or container seated on the support member 35 is elevated, a load may be concentrated into both the side surfaces of the drawer body 38. The reinforcement ribs 381 may maintain the shape of the drawer body 38, particularly, the drawer part 32 even under the concentrated load.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated. The draw-out rail 33 may be a rail that extends in multistage. The draw-out rail 33 may have one end fixed to the storage space inside the cabinet 10 and the other end fixed to the rail mounting part 382 to more stably realize insertion and the withdrawal of the drawer door 30. The rail mounting part 382 may be disposed in an inner region of the drawer flange 380, which will be described below, and may be covered by the outer side plate 391.

A mounting part 383 on which the elevation device 51 that is a main component is mounted may be recessed inside both the side surfaces of the drawer body 38. The mounting part 383 may be recessed outward from the inner surface of the drawer body 38 providing the drawer space.

The mounting part 383 may extend in the vertical direction. Here, the mounting part 383 may vertically extend from the upper end of the drawer body 38 to the bottom surface of the drawer body 38. Here, a lower end of the mounting part 383 may be disposed above a lower end of each of both the side surfaces of the drawer body 38. The lower end of the mounting part 383 may extend up to the rail mounting part 382. Thus, the mounting part 383 may not interfere with the draw-out rail 33 and the constitutes for the mounting of the draw-out rail.

Also, the inner surface of the mounting part 383 may have a shape corresponding to that of the outer surface of the elevation device 51. Here, in the even state in which the load is applied, the stably mounted state of the elevation device 51 may be maintained.

In detail, the mounting part 383 may include a first mounting part 383*c* recessed at a central portion and a second mounting part 383*d* recessed at each of both sides of the first mounting part 383*c*. Here, the first mounting part 383*c* may be further recessed than the second mounting part 383*d* to form a stepped portion between the first mounting part 383*c* and the second mounting part 383*d*. Thus, the elevation device 51 having the corresponding shape may be restricted in the mounted state without rotating.

Also, the elevation device 51 may be disposed on the same plane as the inner surface of the drawer body 38 in the state of being mounted on the mounting part 383 to prevent the interference when the support member 35 is elevated and provide a sense of unity.

A bottom surface of the mounting part 383 may support a lower end of the elevation device 51. Also, the top surface of the mounting part 383 may be opened so that the elevation device 51 is inserted through the opened upper side. Here, the elevation device 51 may be inserted to be slid from the upper side so that both ends of the elevation device 51 is restricted within the mounting part 383.

A mounting part bracket 53 may be disposed on the opened top surface of the mounting part 383. The mounting part bracket 53 may be made of a metal material and restrict the upper end of the elevation device 51.

In detail, the mounting part bracket 53 may be mounted on the upper end of each of both the ends of the drawer body 38 to pass through the opened top surface of the mounting part 383. Here, the mounting part bracket 53 may be fixed to the upper ends of both side surfaces of the drawer body 38, and simultaneously, the elevation device 51 mounted on the mounting part 383 may be restricted.

Also, the mounting part bracket 53 may extend from the front end to rear end of each of both the side surfaces of the drawer body 38 and be firmly fixed to the drawer body 38 by a plurality of fixing members. Thus, the elevation device may be maintained in the state of being more stably and firmly mounted on the drawer body 38.

The elevation device 51 may be connected to both ends of the support member 35 by the connecting bracket 54. Also, the elevation device 51 may operate to allow the support member 35 to vertically move and guide smooth vertical movement of the support member 35.

The transmission member mounting part 384 may be opened outward from the upper end of each of both the side surfaces of the drawer body 38 to communicate with the mounting part 383. Thus, the power transmission member 52 mounted on the transmission member mounting part 384 may be coupled to the elevation device 51 mounted on the mounting part 383 to transmit the power.

The mounting part 383 may have a shape that is recessed from the inner surface of the drawer body 38, and the transmission member mounting part 384 may have a shape that is recessed from the outer surface of the drawer body 38. Thus, when the drawer body 38 is molded, a mold may have a simple structure so that the drawer body 38 is easily molded.

The mounting part 383 and the transmission member mounting part 384 may be disposed inside a region of the drawer flange 380 that is bent outward from an upper end of each of both side surfaces of the drawer body 38. That is, the mounting part 383 and the transmission member mounting part 384 may be disposed below the region in which the drawer flange 380 is bent outward. Also, in addition to the mounting part 383, the transmission member mounting part 384, and the rail mounting part 382, the elevation device 51 and the power transmission member 52, which are mounted on the mounting part 383 and the transmission member mounting part 384, may not also protrude inward or outward from the drawer flange 380. That is, all of the drawer-side device 50 constituting a portion of the elevation assembly 40 and the structure for mounting the drawer-side device 50 may be disposed in the region of the drawer flange 380. Thus, a loss of the storage space inside the drawer body 38 may be prevented from occurring.

The support member 35 of the drawer-side device 50 and the elevation device 51 may be disposed on the inner surface of the drawer body 38, and the power transmission member 52 may be disposed outside the drawer body 38. Also, the mounting part 383 and the transmission member mounting part 384 may communicate with each other, and the power transmission member 52 and the elevation device 51 may be connected to each other in the state of being mounted on the drawer body 38.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, the constituents such as the power transmission member 52 and the draw-out rail 33, which are mounted on both the sides of the drawer body 38 may not be exposed to the outside.

Also, an upper bent part 391*a* may be disposed on an upper end of the outer side plate 391. The upper bent part 391*a* may cover the upper end of each of both the side surfaces of the drawer body 38 and the mounting part bracket 53.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

An extending end of the upper bent part 391*a* may contact the upper end of the inner side plate 391. Thus, all of the inside and outside and the top surface of both the left and right surfaces of the drawer body 38 may be covered by the inner side plate 392 and the outer side plate 391.

Also, a side opening 394 having a size corresponding to the mounting part 383 may be defined in the inner side plate 392. Thus, in the state in which the inner side plate is mounted, the elevation device 51 mounted on the mounting part 383 may be exposed to the inside of the drawer body 38, and since the connecting bracket 54 is mounted, the elevation device 51 may be coupled to the support member 35.

An inner plate 395 may be disposed on each of front, bottom, and rear surfaces of the inside of the drawer body 38. The inner plate 395 may be constituted by a front surface part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* constituting the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal. Thus, the inner surface of the drawer part 32 may more easily transfer heat by the inner side plate 392 and the inner plate 395, and thus, the entire drawer part 32 may be uniformly cooled by the surrounding cold air. Thus, the foods accommodated in the drawer part 32 may be more uniformly cooled and thus stored at a low temperature in the more uniform region. In addition, visually excellent cooling performance and storage performance may be provided to the user.

Also, upper bent parts 395*d* and 395*e* that are bent outward may be further disposed on the front surface part 395*a* and the rear surface part 395*c* of the inner plate 395 to cover the top surfaces of the front end and the rear end of the drawer body 38, respectively. Also, the rear surface part 395*c* may have a shape corresponding to the inclined surface 321 of the rear surface of the drawer body 38 and thus be closely attached to the inclined surface 321.

Also, a bottom surface opening 395*f* may be further defined in the rear end of the bottom surface part 395*b* adjacent to the lower end of the rear surface part 395*c*. The bottom surface opening 395*f* may be opened at a position corresponding to a cover support part 388 protruding from the bottom surface of the drawer body. Thus, the cover support part 388 may be exposed through the bottom surface opening 395*f*. The lower end of the drawer cover 37 may be coupled to the cover support part 388 so that the drawer cover 37 is mounted.

The drawer cover 37 may include a cover front part 371 that partitions the inside of the drawer body 38 into a front space S1 and a rear space S2 and a cover top surface part 372 bent from an upper end of the cover front part 371 to cover a top surface of the rear space S2.

That is, when the drawer cover 37 is mounted, only the front space S1, in which the support member 35 is disposed, may be exposed in the drawer body 38, and the rear space S2 may be covered by the drawer cover 37.

A lower end of the cover front part 371 may be coupled to the cover support part 388. Also, a plurality of cover restriction parts 373 may be disposed along both the left and right ends of the drawer cover 37. The cover restriction part 373 may be disposed at a position corresponding to a plurality of cover restriction protrusions 385 protruding inward from the inner surface of the drawer body 38. Each of the cover restriction protrusions 385 may pass through a protrusion hole 392*b* defined in the inner side plate 392 to protrude.

Also, the cover restriction part 373 may be press-fitted into the cover restriction protrusion 385. When the drawer cover 37 is mounted, the cover restriction protrusion 385 may be coupled to the cove restriction part 373 to fix the drawer cover 37.

The support member 35 may be provided in the drawer body 38. The support member 35 may include one component of the elevation assembly 40. The support member 35 may have a size that is enough to be accommodated in the front space S1 of the bottom surface of the drawer body 38.

Also, the support member 35 may have a plate shape as illustrated in FIG. 3. Substantially, the support member 35 may include an elevation plate 351 supporting the food or container and an elevation frame 352 supporting the elevation plate 351 at a lower side and reinforcing strength of the elevation plate 351. The support member 35 may be a portion on which the food or container 36 is substantially seated and supported and thus may be called a seating member or a tray. Also, as necessary, the support member 35 may be provided as one of the elevation plate 351 or the elevation frame 352.

The elevation plate 351 may have a rectangular plate shape and also protrude upward along the circumference and contact a circumference of the bottom surface of the container 36 to prevent the container 36 from moving.

The connecting bracket 54 may have one side fixed to the elevation frame 352 and the other side coupled to the elevation device 51. Thus, when the elevation device 51 operates, the elevation frame 352 connected to the connecting bracket 54, i.e., the support member 35 may vertically move together with the connecting bracket 54.

The elevation device 51 extending in a direction that perpendicularly crosses the draw-out direction of the drawer part 32 may be mounted on the drawer body 38. The elevation device 50 may include the support member 35 and an elevation device 51 disposed on each of both sides of the support member 35 to transmit power for the vertical movement of the support member 35 and guide the vertical movement of the support member 35.

Hereinafter, a structure of the elevation assembly 40 will be described in more detail with reference to the accompanying drawings.

Figure 8:
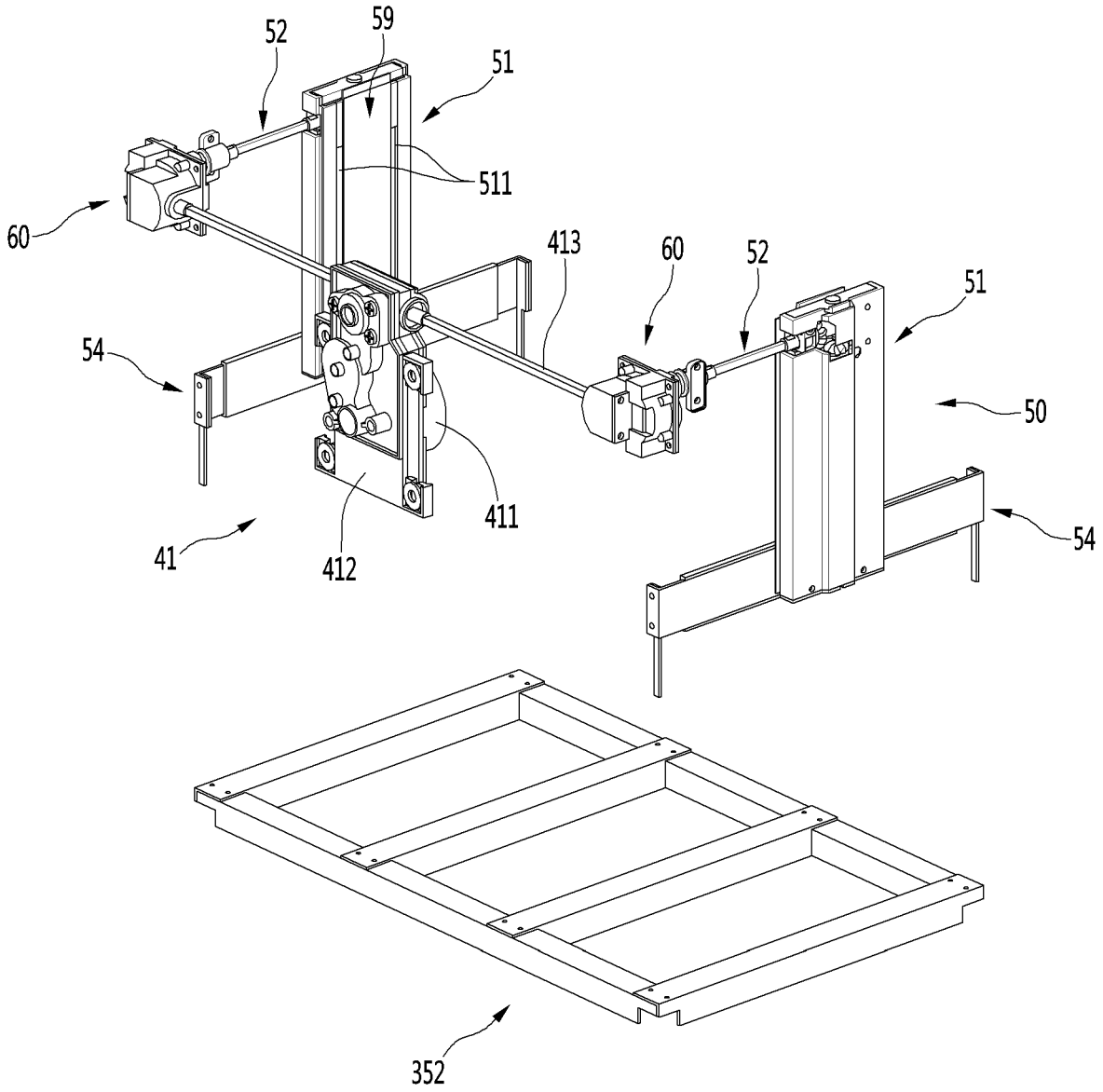
FIG. 8 is an exploded perspective view illustrating a coupling structure between an elevation assembly and a support member of the refrigerator.

FIG. 8 is an exploded perspective view illustrating a coupling structure between the elevation assembly and the support member of the refrigerator.

As illustrated in the drawing, the elevation assembly 40 may be constituted by the driving device 41 disposed in the front panel door part 31 and the drawer-side device 50 disposed in the drawer part 32. Also, the driving device 41 and the drawer-side device 50 may be coupled to each other by coupling the front panel door part 31 to the drawer part 32 to transmit the power.

As described above, the driving device 41 may include the motor assembly 412 including a driving motor 411, the driving shaft 413 coupled to the motor assembly to rotate and connected to the connection device, and the connection device 60 connected to transmit the power to the drawer-side device 50.

Although one motor assembly 412 is provided in FIG. 8 as an example, when it is determined that a greater torque is required for elevating the support member 35, a pair of motor assemblies may be provided, and the drive shafts 413 are disposed in the respective motor assemblies to individually transmit the power to the pair of elevation devices. The motor assembly 412 may be disposed in parallel to the front surface of the front panel door part 31 to minimize an insulation space loss of the front panel door part 31.

Although one or two motor assembles 412 are provided, both the driving shafts 413 may rotate by the same rotation rate at the same time. Thus, the pair of elevation devices 51 may be elevated up to the same height by the same rotation force transmitted by the connection device 60 and the power transmission member 52 to prevent the support member 35 from being tilted. For this, the driving shaft 413 may have a structure in which one shaft or a plurality of shafts passing through the motor assembly 412 rotates together with each other.

The drawer-side device 50 may include the support member 35 provided inside the drawer body 38, the elevation device 51 and the connecting bracket 54, which disposed on both the sides of the support member 35 to elevate the support member 35, and the power transmission member 52 disposed outside the drawer body 38 to transmit the rotation force of the driving device 41 to the elevation device 51.

When the motor assembly 412 is driven, the rotation force of the driving shaft 413 may be transmitted to the drawer-side device 50 by the connection device 60 and the power transmission member 52, which are coupled to each other.

Also, a connecting bracket 54 which moves vertically according to the operation of the elevation device 51 may be mounted on the elevation device 51. Also, both ends of the elevation frame 352, which is a component of the support member 35, may be fixed to the connecting bracket 54. Thus, the support member 35 may move vertically together with the connecting bracket 54 when the elevation device 51 operates.

Hereinafter, each of constituents of the elevation assembly 40 will be described in more detail with reference to the accompanying drawings.

Figure 9:
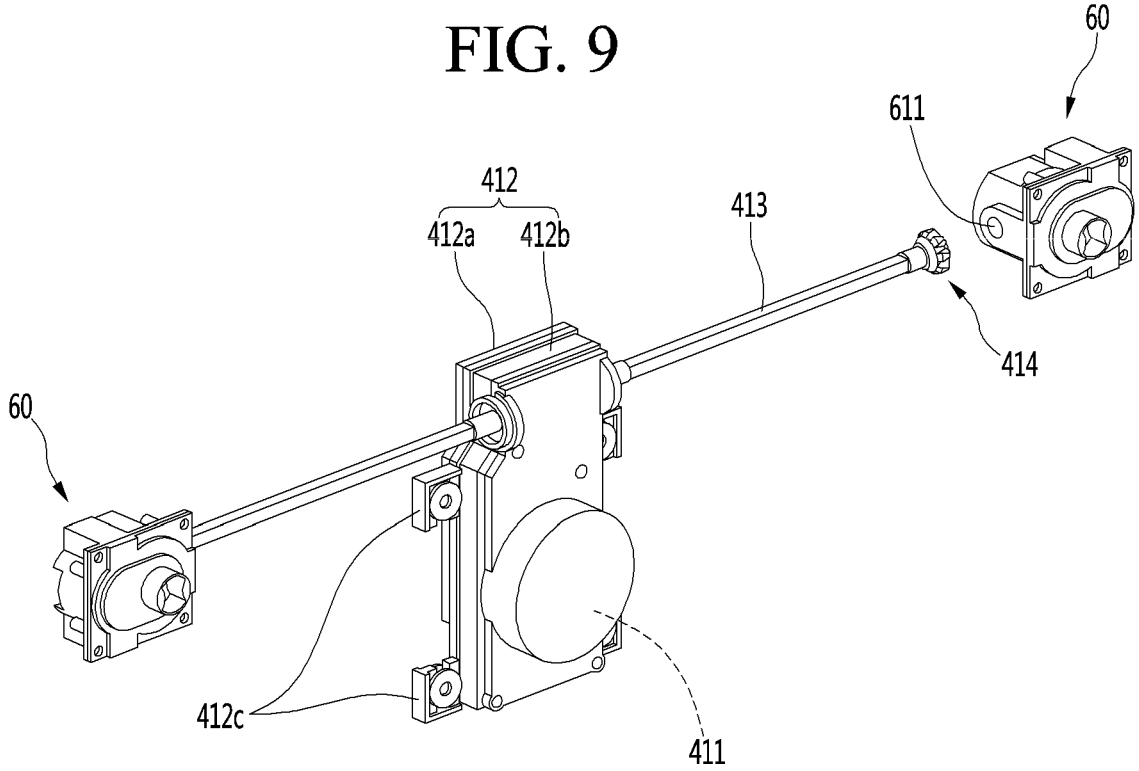
FIG. 9 is a perspective view illustrating a driving device of the elevation assembly.
Figure 10:
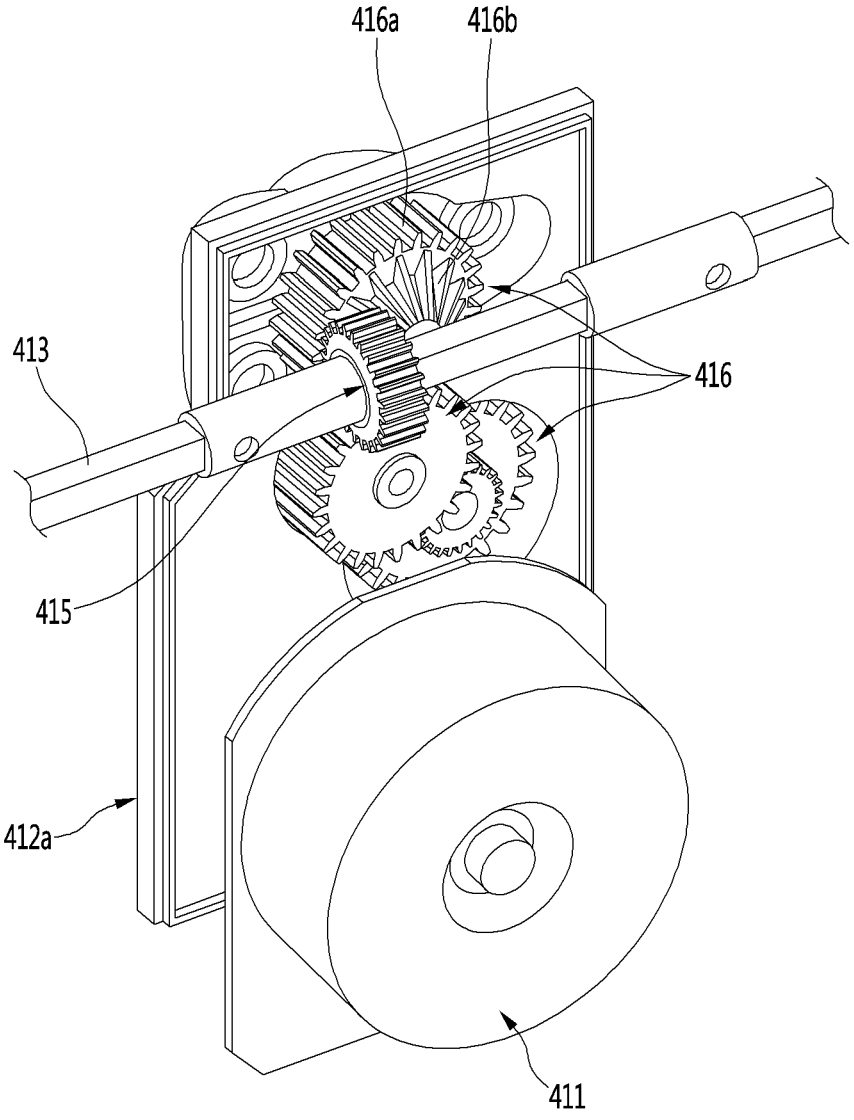
FIG. 10 is a view illustrating a coupling structure of a motor assembly and a driving shaft of a driving device.

FIG. 9 is a perspective view illustrating the driving device of the elevation assembly. Also, FIG. 10 is a view illustrating a coupling structure of the motor assembly and the driving shaft of the driving device.

As illustrated in the drawings, the driving device 41 may include the motor assembly 412 disposed at a center of the front panel door part 31, the driving shaft passing through the motor assembly 412, and the connection device 60 gear-coupled to both ends of the driving shaft 413.

The motor assembly 412 may include a plurality of gears 416, a motor case 412*a*, and a motor cover 412*b*.

In detail, the motor case 412*a* and the motor cover 412*b* may define an outer shape of the motor assembly 412 and are disposed between the motor case 412*a* and the motor cover 412*b* so that the driving motor 411 and the plurality of gears 416 are accommodated. Also, the plurality of gears 416 may be interlocked to rotate when the driving motor 411 is driven. Also, the driving shaft 413 passing the motor case 412*a* and/or the motor cover 412*b* may be disposed on an upper portion of the motor assembly 412, and the driving shaft 413 may be coupled to the plurality of gears 416 to rotate.

The driving motor 411 may provide power for elevating the elevation device and may rotate forwardly and reversely. Thus, when an elevation signal of the elevation device 51 is inputted, the elevation device 51 may rotate forwardly and reversely to provide the power for elevating the elevation device 51. Also, an input of a stop signal due to the load of the driving motor 411 or the detection of the sensor may be stopped.

The driving motor 411 may be fixed and mounted on a lower portion of the motor case 412*a*, and the rotation shaft of the driving motor 411 may be gear-coupled to the plurality of gears 416 to allow the plurality of gears 416 to rotate.

The plurality of gears 416 may be configured to decelerate the rotation force of the driving motor 411 and transmit the rotation force, and the plurality of gears 416 may be combined with each other and gear-coupled to each other to transmit set rotation force. The plurality of gears 416 may be variously combined according to the reduction ratio and the magnitude of the transmitted force. The plurality of gears 416 may include at least a gear coupled with the rotation shaft of the driving motor 411 and a gear coupled to the drive shaft 413.

The gear 416 may include a power transmission part 416*a* and a power conversion part 416*b*. The power transmission part 416*a* is configured so as to be engaged with the neighboring gear 416 in the form of a spur gear. Also, the power conversion part 416*b* may be configured to be gear-coupled to the shaft driving gear 415 mounted on the driving shaft 413.

The drive shaft 413 may pass through the motor assembly 412 in a lateral direction and may extend in a direction perpendicular to the rotation axis of the driving motor 411 and the rotation axis of the gear 416. Also, the shaft driving gear 415 is disposed inside the motor assembly 412 and may be gear-coupled perpendicularly to the power conversion part 416*b*. Thus, the power conversion part 416*b* may have the same shape as a bevel gear so that power transmission to the driving shaft 413 is performed. The power conversion part 416*b* and the shaft driving gear 415 may have other gear structures capable of transmitting the power.

The motor assembly 412 may be accommodated inside the recess part 314*a* defined in the door liner 314, and the coupling member such as a screw may be fixed to the case fixing part 412*c* protruding on both sides of the motor assembly 412 to fix the motor case 412*a*.

Also, the driving shaft 413 passing through the motor case 412*a* may be accommodated in the recess part 314*a* on the door liner 314 and may rotate when the driving motor 411 is driven. Also, the connection device connected to both ends of the driving shaft 413 may be accommodated in the inside of the recess part 314*a* and may be fixed on the door cover 315.

Thus, the driving device 41 may be fixedly mounted inside the front panel door part 31, and the rotation force of the driving motor 411 may be transmitted to the connection device 60.

For this, the first connection gear 414 may be provided on both ends of the driving shaft 413. The first connection gear 414 may be rotatable together with the driving shaft 413 and may be gear-coupled to the second connection gear 64 in the connection device 60. Here, the first connection gear 414 and the second connection gear 64 may have the same shape as the bevel gear to transmit the gear coupling and the rotation force in a state in which the first connection gear 414 and the second connection gear 64 cross each other at right angles.

Hereinafter, a structure of the connection device will be described in more detail.

Figure 11:
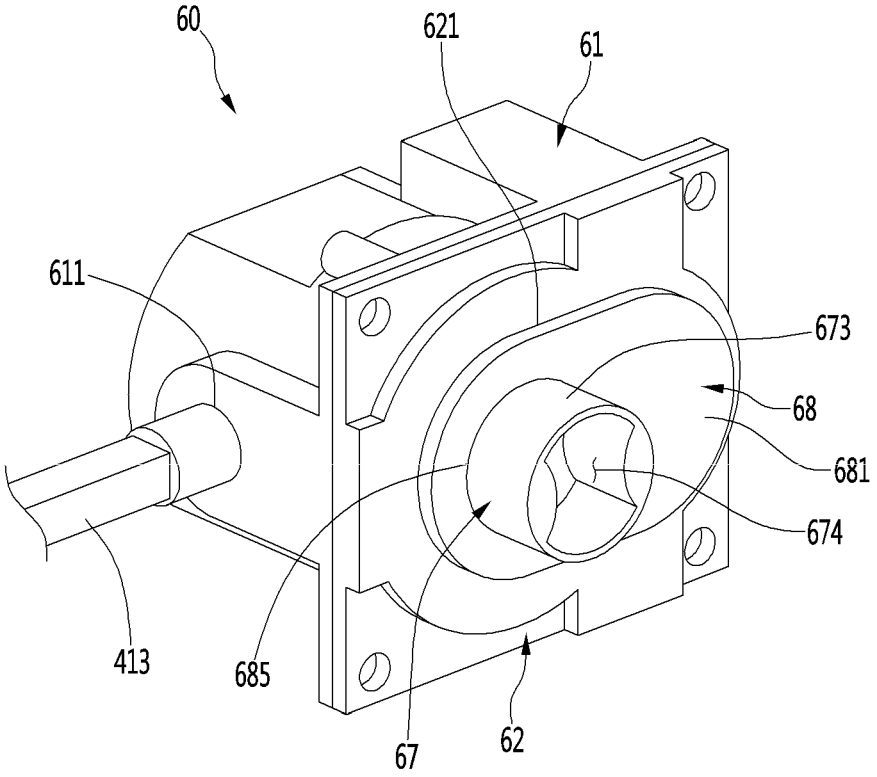
FIG. 11 is a perspective view illustrating a state in which a connection device is coupled to the driving shat according to an embodiment.
Figure 12:
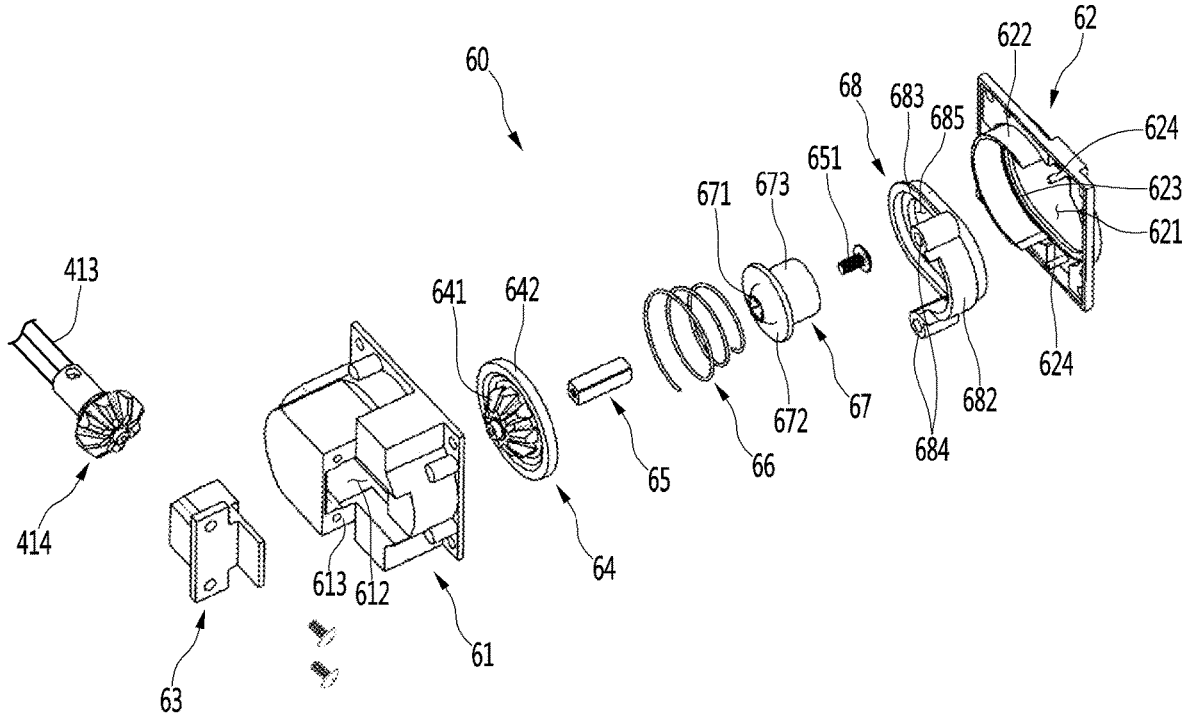
FIG. 12 is an exploded perspective view of the connection device.
Figure 13:
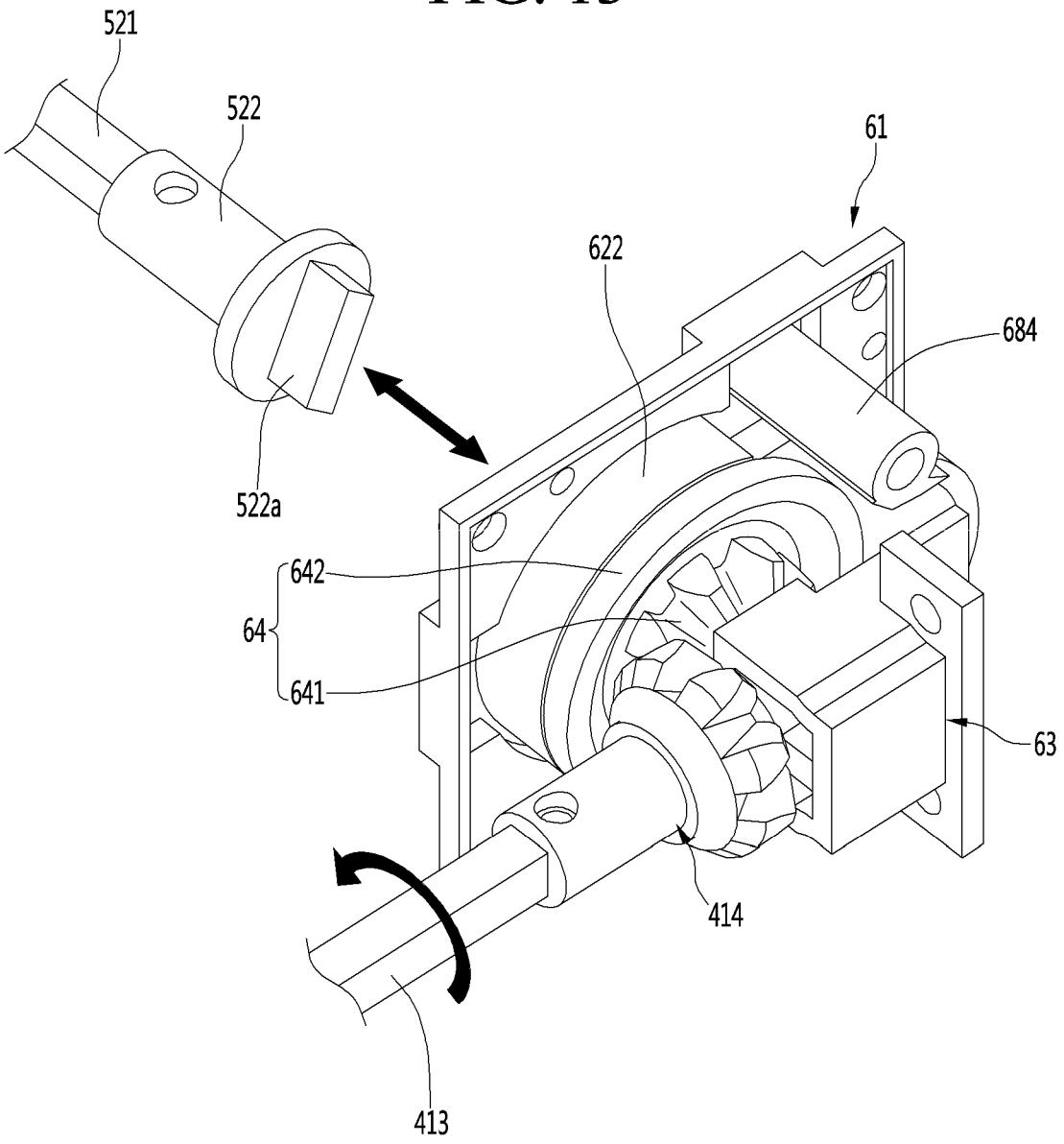
FIG. 13 is a view of a power transmission structure through the connection device.

FIG. 11 is a perspective view illustrating a state in which a connection device is coupled to the driving shat according to an embodiment. Also, FIG. 12 is an exploded perspective view of the connection device. Also, FIG. 13 is a view of a power transmission structure through the connection device.

As illustrated in the drawings, an outer appearance of the connection device 60 is defined by a connection device case 61 and a connection device cover 62. Also, a second connection gear 64, a coupling member 65, an elastic member 66, a first connection member 67, and a push member 68 may be provided in a space defined by the connection device case 61 and the connection device cover 62.

In more detail, the connection device case 61 may be opened toward the inside, i.e., the rear surface of the cabinet 10 to define a space in which the second connection gear 64, the coupling member 65, the elastic member, 66 and the push member 68 are disposed.

Figure 23:
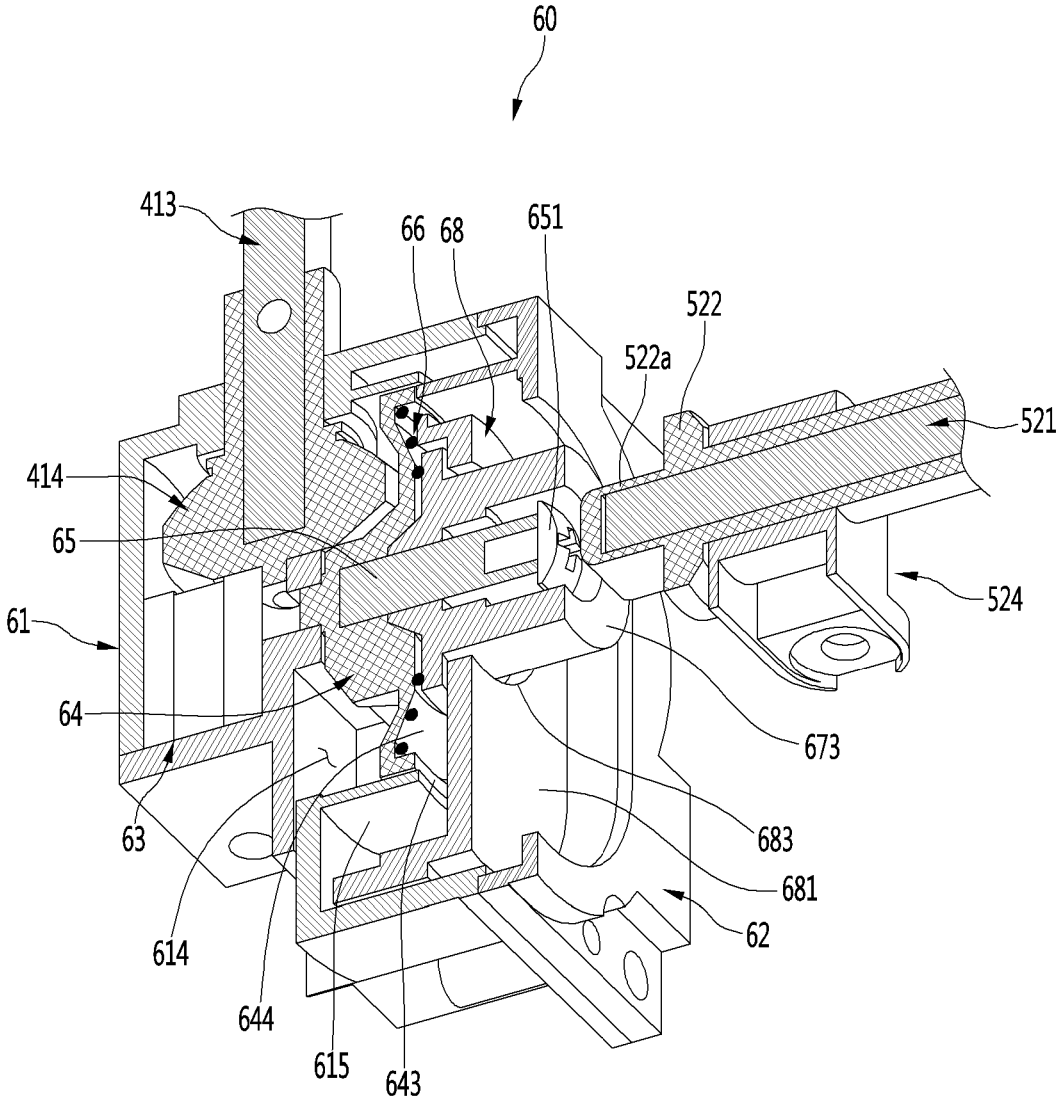
FIG. 23 is a cross-sectional view of FIG. 22.

Also, as illustrated in FIG. 23, a connection gear mounting part 615 providing a space in which the second connection gear 64 is accommodated may be provided in the space 614. The connection gear mounting part 615 may extend from the inside of the connection device case 61 to contact the circumferential part 644 of the first connection gear 414. Thus, the second connection gear 64 may be disposed inside the connection gear mounting part 615 after the connection device 60 is assembled and may be maintained in a position at which the second connection gear 64 is capable of being coupled to the first connection gear 414 in any state.

Also, a shaft hole 611 through which the drive shaft 413 passes may be defined in one surface of the connection device case 61. A case opening 612 may be defined in one side of the connection device case 61 facing the shaft hole 611, and the first connection gear 414 coupled to the driving shaft 413 may be exposed. A stepped part 613 may be disposed on one surface of the connection device 60 in which the case opening 612 is defined, and the gear support member 63 may be coupled to the stepped part 613.

The gear support member 63 may support a central portion of the first connection gear 414 exposed to the case opening 612. Thus, the first connection gear 414 may support the connection device case 61 to rotate while maintaining the mounted position. The gear support member 63 may have a shape corresponding to the stepped part 613 and may be coupled to the connection device case 61 by a screw.

A gear part 641 may be disposed on the second connection gear 64, and the second connection gear 64 may be disposed to be gear-coupled to the first connection gear 414 in the connection device case 61. The second connection gears 64 may be disposed in a direction perpendicular to the first connection gear 414 and have a bevel gear shape so as to be coupled to each other.

Also, a planar gear support part 642 may be disposed on one surface of the first connection gear 414 facing the gear part 641 to contact the elastic member 66. The second connection gear 64 may be pressed by the elastic member 66 in a direction to be coupled to the first connection gear 414, and the first connection gear 414 and the second connection gear may be maintained in the state of being always coupled to each other.

Figure 20:
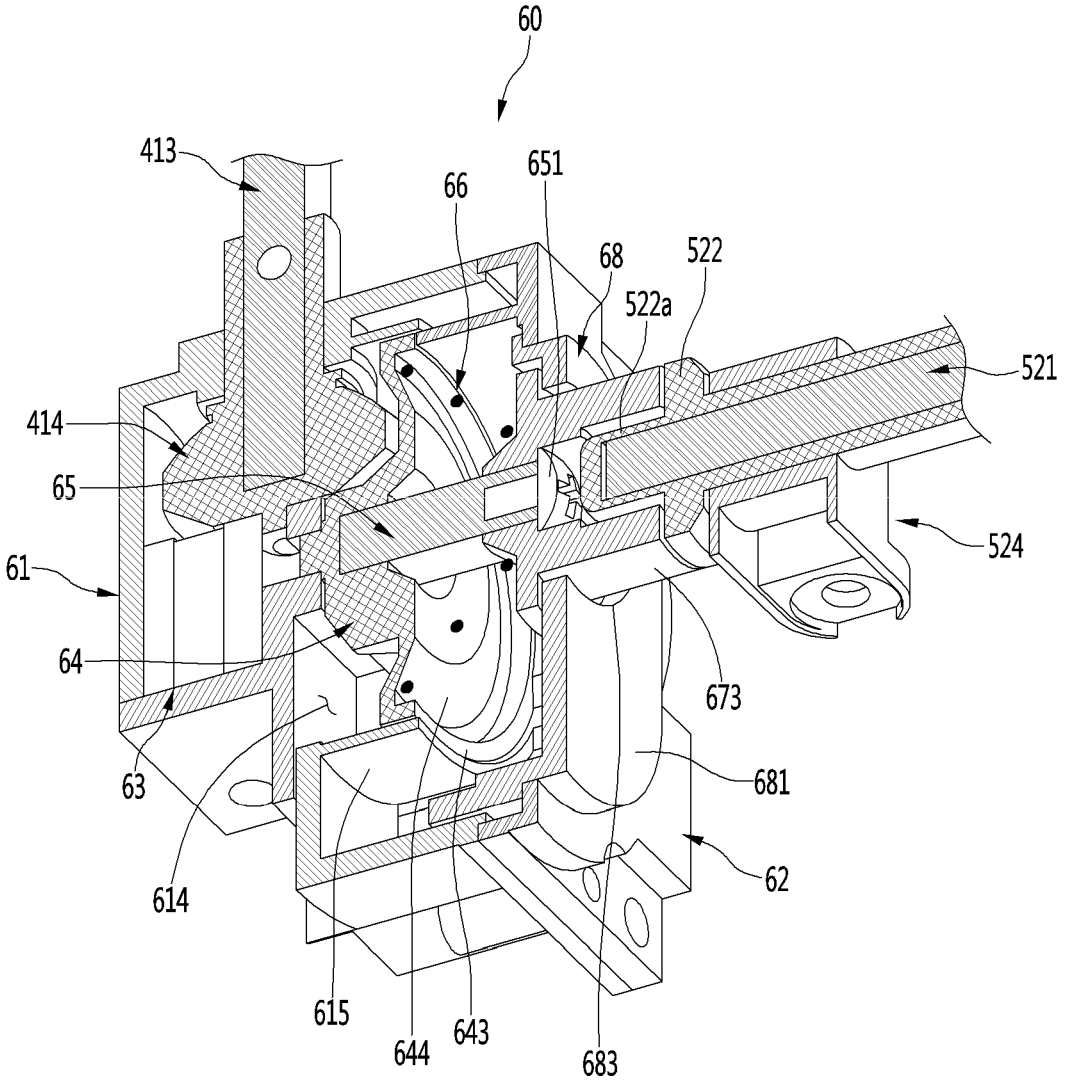
FIG. 20 is a cross-sectional view of FIG. 19.

Also, as illustrated in FIG. 20, a circumferential part 644 extending backward may be disposed on a circumference of the gear support part 642. The circumferential part 644 may extend vertically toward the first connection member 67 and be disposed to contact the inner surface of the connection gear mounting part 615. Thus, the second connection gear 64 may maintain its mounted position without moving inside the transmission member mounting part 384.

Also, the elastic member 66 contacting the gear support part 642 may be maintained in contact with the gear support part 642 without being separated from the gear support part 642 by the circumferential part 644. At least a portion of the gear support part 642 may be disposed on an inclined part having the form of an inclined surface so that the mounting of the elastic member 66 is more firmly maintained, and the stably mounted state may be maintained even when the elastic member 66 is compressed.

Also, a coupling member 65 may be inserted into the center of the second connection gear 64. The coupling member 65 may connect the second connection gear 64 and the first connection member 67. Thus, one end of the coupling member 65 may be inserted into the center of the second connection gear 64, and the other end of the coupling member 65 may be inserted into the center of the first connection member 67. Also, the coupling member 65 may have a rod shape having a polygonal cross-section. When the second connection gear 64 rotates, the first connection member 67 may rotate together, and also, the first connection member 67 may move along the coupling member 65.

Also, the elastic member 66 may be disposed between the first connection member 67 and the second connection gear 64. Thus, the elastic member 66 may be compressed according to the movement of the first connection member 67, and the first connection member 67 may return to the initial position by restoring force of the elastic member 66.

The first connection member 67 may have an insertion hole 671 in the center thereof for inserting the coupling member 65. The screw 651 may be coupled to the end of the coupling member 65 disposed inside the insertion hole 671 to prevent the coupling member 65 and the first connection member 67 from being separated from each other. The screw 651 may pass through the first connection member 67 in a direction opposite to the direction in which the coupling member 65 is inserted.

Also, a support part 672 may be disposed on the first connection member 67. The support part 672 may support one end of the elastic member 66 and be disposed at a position facing the gear support part 642 of the second connection gear 64. Thus, the elastic member 66 having a coil spring may support the first connection member 67 and the second connection gear 64 and be compressed when the first connection member 67 moves.

A first connection part 673 may extends to the first connection member 67. The first connection part 673 may be a portion to be connected to the second connection part 522*a* disposed on the power transmission member 52 and extend through the push member 68 to the outside of the connection device cover 62. Also, an outer diameter of the first connection part 673 may be smaller than that of the support part 672 and may be provided to correspond to the through-hole 685 of the push member 68 at all times. Thus, the support part 672 may be supported around the through-hole 685 of the push member 68.

That is, the first connection member 67 may maintain a state of being closely attached to the rear surface of the push member 68. Thus, the first connection member 67 and the push member 68 may move together when the push member 68 is pressed or when the elastic member 66 returns to the initial position.

The insertion hole 671 may be defined in one side of the first connection member 67, and a coupling hole 674 may be defined in the other side of the first connection member 67.

The coupling hole 674 may be defined in the end of the first connection part 673 protruding to the outside of the connection device 60 and may communicate with the insertion hole 671. Thus, the screw 651 may be coupled to the coupling member 65 through the coupling hole 674. Also, an inner surface of the coupling hole 674 may have a concave/convex shape or a rounded shape that protrudes or is recessed. The second connection part 522*a* having a protrusion shape may be inserted to match the second connection member 522. That is, the first connection part 673 and the second connection part 522*a* may be coupled to each other by the coupling hole 674, and the rotation power of the first connection member 67 may be transmitted to the second connection member 522, i.e., the power transmission member 52.

The push member 68 may be provided inside the connection device case 61 and may be exposed through the opening 621 of the connection device cover 62 so that the push member 68 is pressed by the user. The push member 68 may include a push part 681 exposed through an opening 621 of the connection device cover 62 and a push guide surface 682 extending along a portion of the circumference of the push part 681.

A through-hole 685 through which the first connection part 673 passes may be defined in the push part 681. The through-hole 685 may be larger than the outer diameter of the first connection part 673 and slightly smaller than the outer diameter of the support part 672. Thus, when the push part 681 may be pushed to move the push member 68, the first connection member 67 contacting the push member 68 may also move together to release the coupling between the first connection member and the second connection member of the power transmission member 52.

Also, the circumference of the push part 681 may extend toward the connection device case 61 and then be bent outward to provide a push flange 683. Thus, the push flange 683 may interfere with the opening 621 of the connection device cover so that the push member 68 is restricted by the connection device cover 62 without being separated. For this, the opening of the connection device cover 62 may have a stepped part 623, and the push flange 683 may be accommodated into the rear surface of the stepped part 623.

A guide surface 682 extending along the circumference of the push part 681 and contacting an inner surface of the connection device case 61 and a guide boss 684 provided on both sides of the guide surface 682 may be disposed on one side of the push part 681. Also, the guide boss 684 may be penetrated by a guide post 624 extending from the rear surface of the connection device cover 62. Of course, the guide post 624 may pass through the guide boss 684 from the inside of the connection device cover 62, but not pass through the connection device cover 62.

Thus, when the push member 68 move forward and backward, the guide surface 682 may maintains the contact with the inner surface of the connection device case 61, and the guide boss 684 may move along the guide post 624 on each of both sides. Thus, the push member 68 may move forward and backward in the stable state without moving.

The connection device cover 62 may be mounted on the opened front side of the connection device case 61, and the opening 621 may be defined to expose the push part 681. The connection device cover 62 may be firmly fixed to the connection device case 61 by the coupling member. Thus, the configuration of the connection device case 61 may be maintained in the mounted state.

Also, the push member guide part 622 may extend to a portion of the circumference of the opening 621. The push member guide part 622 may extend toward the inside of the connection device case 61 and contact the circumferential surface of the push member 68 when the push member 68 to guide the movement of the push member 68. The push member guide part 622 may contact the circumferential portion of the push member 68 on which the guide surface 682 is not provided.

Also, the connection device 60 may be fixedly mounted on the door cover 315 and be disposed at a position at which the push member 68 is exposed even when the front panel door part 31 and the drawer part 32 are coupled to each other. Thus, the user may manipulate the push part 681 in the state in which the front panel door part 31 and the drawer part 32 are coupled to each other.

Figure 14:
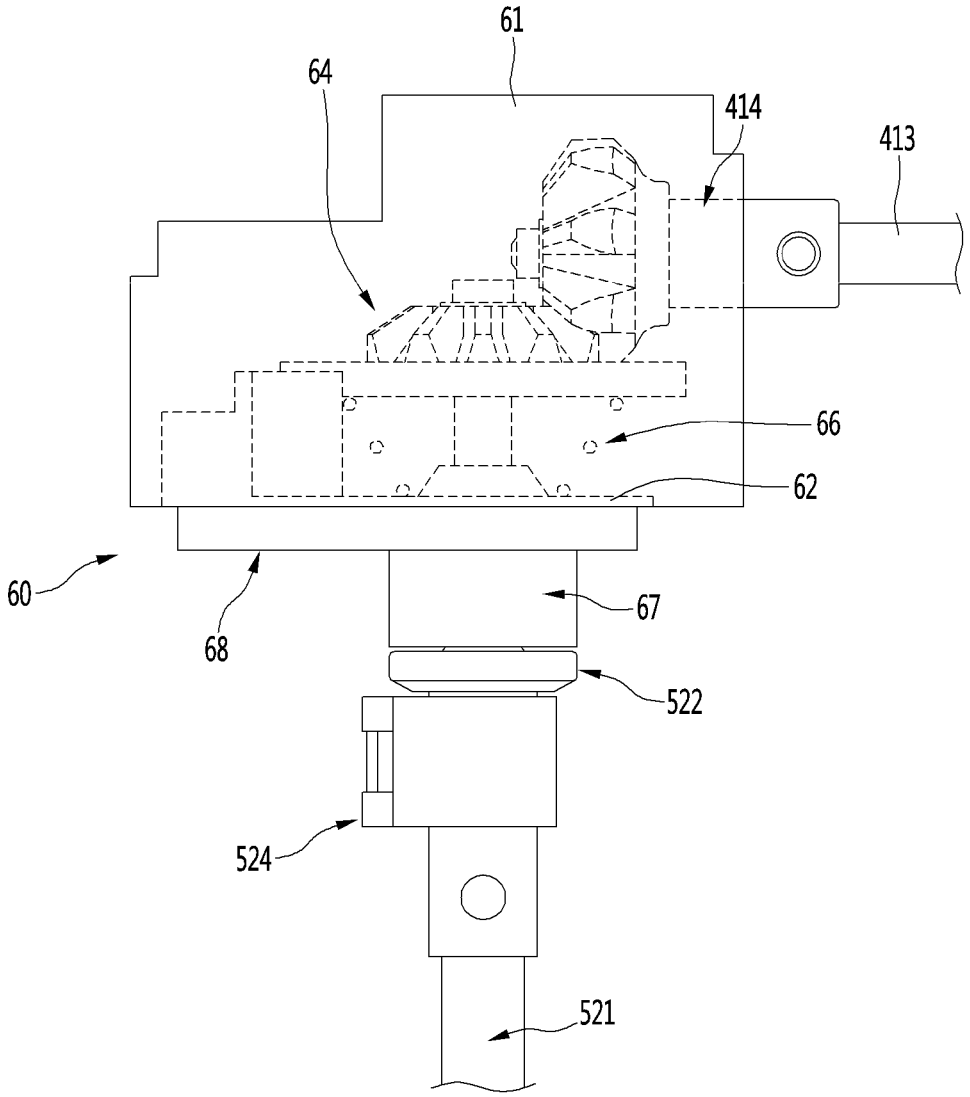
FIG. 14 is a view of an inner structure before the connection device is manipulated.
Figure 15:
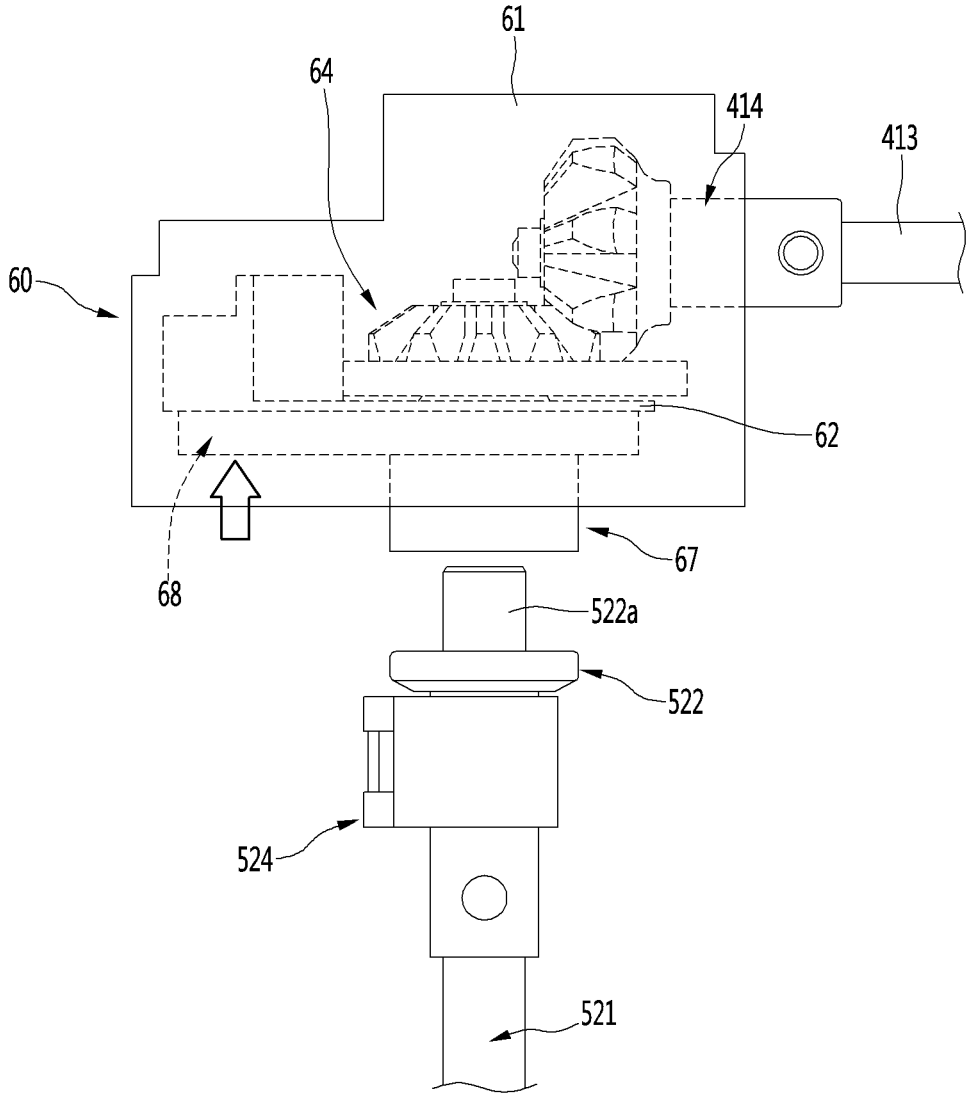
FIG. 15 is a view of an inner structure during the manipulation of the connection device.

FIG. 14 is a view of an inner structure before the connection device is manipulated. Also, FIG. 15 is a view of an inner structure during the manipulation of the connection device.

As illustrated in FIG. 14, the second connection gear and the first connecting member 67 may be supported by the elastic member 66 in the state in which the push member 68 is not depressed by the user.

In this state, one end of the elastic member 66 may elastically support the second connection gear 64 to maintain the coupled state between the second connection gear 64 and the first connection gear 414. Also, the other end of the elastic member may elastically support the first connection gear 67 to maintain the coupled state between the first connection gear 67 and the second connection gear 522.

That is, the power transmission member 52 may be connected to the connection device to transmit the rotation force of the driving shaft 413 to the second connection gear through the first connection gear. When the second connection gear 64 and the first connection member 67 rotate, the second connection member 522 coupled to the first connection member 67 may rotate. Thus, the power of the driving device 41 may be transmitted to the power transmission member 52, and eventually the power may be transmitted to the elevation device 51.

The user may press the push member 68 to manipulate the separation of the elevation assembly 40 or the separation of the front panel door part 31 and the drawer part 32. When the push member 68 is pushed to be manipulated, the connection device 60 and the power transmission member 52 may be separated from each other as shown in FIG. 15.

In detail, the user may push the push member 68 to manipulate the push member 68. When the push member 68 is pushed, the elastic member 66 may be compressed to allow the push member 68 to move into the connection device case 61. Here, the push member 68 and the first connection member 67 may move together.

Thus, the first connection member 67 and the second connection member 522 may be separated from each other. Thus, the driving device 41 and the power transmission member 52 may be separated from each other. In this state, the front panel door part 31 and the drawer part 32 may be separated from each other through the release of the coupling of the door frame 316. Also, the elevation assembly 40 may be naturally separated from the driving device 41 of the front panel door part 31 and the power transmission member 52 and the elevation device 51 of the drawer part 32.

Hereinafter, a structure of the power transmission member 52 and the elevation device 51 will be described in more detail with reference to the accompanying drawings.

Figure 16:
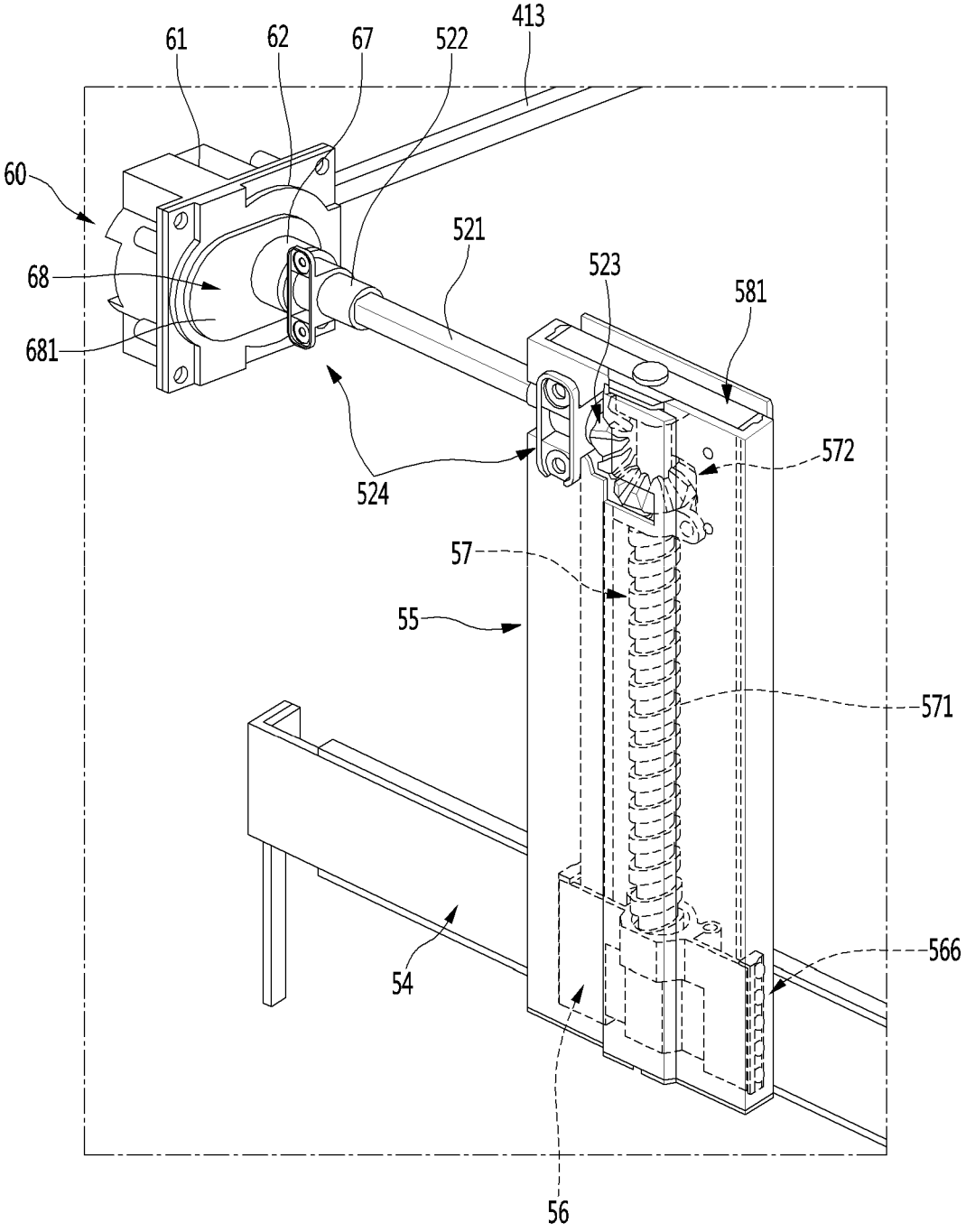
FIG. 16 is a view illustrating a structure of a power transmission member and the elevation device of the elevation assembly.
Figure 17:
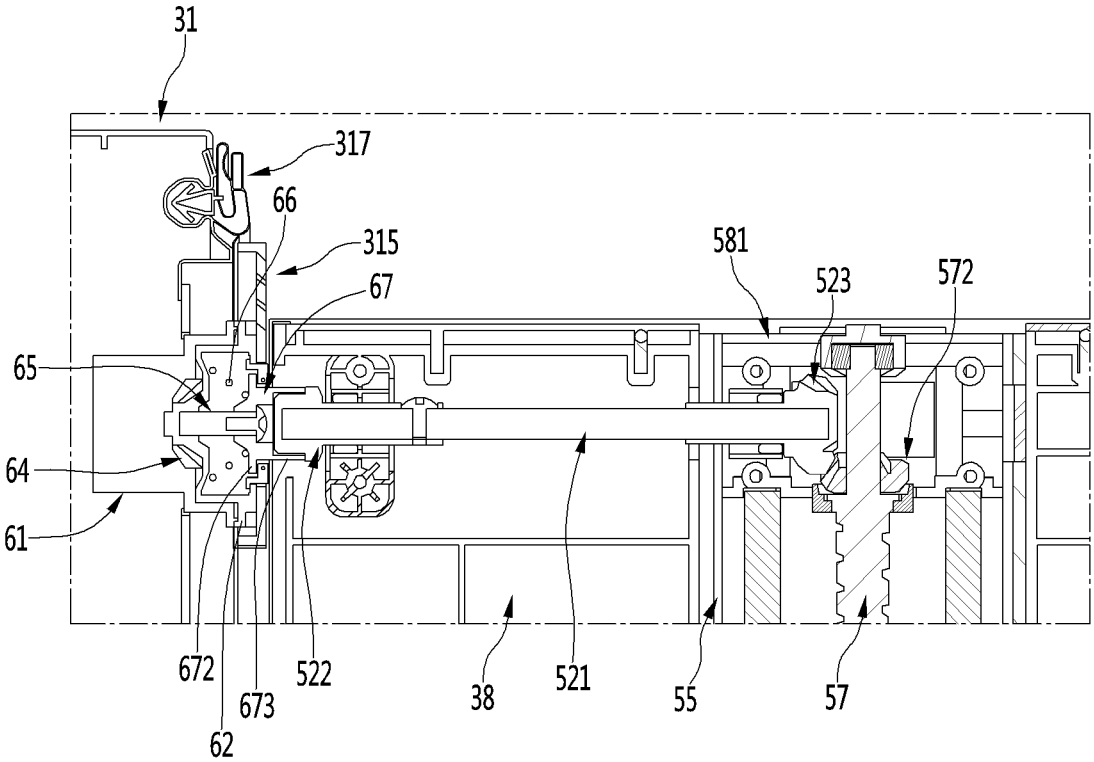
FIG. 17 is a cross-sectional view illustrating a coupling relationship between the connection device, the power transmission member, and the elevation device.

FIG. 16 is a view illustrating a structure of the power transmission member and the elevation device of the elevation assembly. Also, FIG. 17 is a cross-sectional view illustrating a coupling relationship between the connection device, the power transmission member, and the elevation device.

As illustrated in the drawings, the drawer-side device 50 disposed in the drawer body 38 of the elevation assembly 40 may be mounted in the drawer body 38. The drawer-side device 50 may include the elevation member 35, the elevation device 51 disposed on each of both the sides of the elevation member 35 and mounted inside the elevation device 51, and the power transmission member 52.

When the motor assembly 412 is driven, the rotation force of the driving shaft 413 may be transmitted to the connection device 60 and then be transmitted to the power transmission member 52 by the first connection member 67 and the second connection member 522, which are coupled to each other. When the power transmission member 52 rotates by the transmitted power, the elevation shaft 57 inside of the elevation device 51 coupled to the power transmission member 52 may rotate.

A block holder coupled to the elevation shaft 57 may vertically move through the rotation of the elevation shaft 57. The block holder 56 may be coupled to the connecting bracket 54 to elevate the connecting bracket 5, and the connecting bracket 54 disposed each of both the left and right sides may elevate the elevation member 35 in the state of being coupled to the elevation frame 352.

That is, the rotation force of the motor assembly 412 may be transmitted to the power transmission member 52 through the driving shaft 413, and the elevation shaft 57 may rotate by the power transmission member 52. The block holder 56 and the connecting bracket 54 may move vertically by the rotation of the elevation shaft 57. The elevation member 35 coupled to the connecting bracket 54 may also move vertically.

The arranged position of the elevation device 51 may be a position corresponding to a center of the front space S1 in the front and rear direction and be disposed at a position corresponding to a central portion of each of both the side surfaces of the elevation member 35. Thus, the elevation member 35 may be stably elevated without being tilted.

The elevation device 51 may include the rail housing 55 mounted on the mounting part 383 to define the inner space, the upper and lower caps 581 and 585 covering the upper and lower ends of the housing 55 and the block holder 56, which move along the elevation shaft 57 within the housing 55, and the rail cover 59 covering the opened one surface of the housing 55.

When the rail cover 59 is mounted, the opened portion of the rail cover 59 may be covered. Also, the rail housing 55 and the rail cover 59 may include a pair of guide slits 511 extending in the vertical direction. The elevation block 567 and the block holder 56 may be elevated along the pair of guide slits 511.

Also, the rail housing 55 may be made of a plate-shaped metal material and have a protruding central portion. Here, both side ends of the central portion may extend to be stepped. Also, the rail housing 55 may provide a space in which the elevation shaft 57 and the block holder 56 are accommodated.

Particularly, an inner space of the rail housing 55 may provide a space in which both ends of the block holder 56 are accommodated, and a central portion of the block holder 56 may protrude through a housing opening 551 that is opened in the rail housing 55. Also, the block holder 56 may move along the housing opening 551.

An opening may be defined in the upper portion of the rail housing 55 in a corresponding shape so that an end portion of the power transmission member 52 extending toward the elevation device 51 is accommodated.

The elevation shaft 57 may be accommodated in the rail housing 55 and disposed at the central portion of the rail housing. Also, a screw thread 4571 may be provided on an outer circumferential surface of the elevation shaft 57 so that the elevation block 567 vertically moves along the elevation shaft 57 when the elevation shaft 57 rotates.

The elevation shaft 57 may vertically extend inside the rail housing 55, and upper and lower ends of the elevation shaft 57 may be rotatably supported inside the rail housing 55. Also, the screw thread 571 may be disposed between the upper and lower ends of the elevation shaft 57.

Also, a shaft gear 572 may be disposed on an upper portion of the elevation shaft 57, i.e., an upper end of the screw thread 571. The shaft gear 572 may be disposed above an end of the screw thread 571 and be integrally coupled to the elevation shaft 57 to rotate together with the elevation shaft 57. Also, the shaft gear 572 may be gear-coupled to the power transmission member 52 in the state of perpendicularly crossing the transmission gear 523 mounted on the power transmission member 52.

The block holder 56 may pass through the central portion of the shaft gear 572. The shaft gear 572 may have a shape corresponding to the inner space of the rail housing 55 so as to be guided vertically move along the rail housing 55 when the elevation shaft 57 rotates.

The outer shape of the block holder 56 may correspond to the inner shape of the rail housing 55. Particularly, the central portion of the block holder 56 may protrude and be inserted into the central portion of the rail housing 55. Both side surfaces of the block holder 56 may protrude laterally and be accommodated in both inner side surfaces of the rail housing 55. Also, the inner surface of the block holder 56 may protrude through the housing opening 551 and be exposed to the inside of the drawer part 32 so as to be coupled to the elevation member 35 or the connecting bracket 54.

As described above, the outer shape of the block holder 56 and the inner shape of the rail housing 55 corresponding to the outer shape of the block holder 56 may be formed in multistage or in a stepped shape. When the elevation member 35 is elevated, it may be possible to effectively distribute and support the load applied to the elevation direction or the forward and backward direction, thereby realizing the stable elevation.

Also, a rolling member 566 constituted by a plurality of ball bearings arranged in the vertical direction may be provided on both sides of the block holder 56. The rolling member 566 may be disposed between both side surfaces of the block holder 56 and the inner surface of the elevation device 50 to smoothly elevate the block holder 56.

That is, the block holder 56 may move upward and downward by the rotation of the elevation shaft 57, and the block holder 56 may be connected to the elevation member 35 to provide power for the elevation of the elevation member 35. Simultaneously, the elevation device 50 may be configured such that the block holder 56 having a multistage shape is guided along the rail assembly 50 from the inside of the elevation device 50 to guide the vertical movement of the elevation member 35.

A hollow space may be defined in the inside of the block holder 56, and the rail cover 59 may be accommodated in the inside of the block holder 56. Also, the block holder 56 may vertically move along the guide slit 511 defined by the rail cover 59 and the rail housing 55.

The rail cover 59 may cover the housing opening 551 and define the guide slit 511. In detail, the rail cover 59 may be made of a plate-shaped metal material like the inner side plate 392.

The rail cover 59 may cover the housing opening 551 to cover the constituents accommodated in the rail housing 55. For this, the rail cover 59 may be disposed in the housing opening 551. Each of both ends of the rail cover may be bent to the inside of the rail housing 55 and then bent outward to form the guide slit 511. Also, the block holder 56 may vertically move along the guide slit 511.

The rail cover 59 may have a cross-sectional shape corresponding to the hollow shape within the block holder 56 to pass through the hollow of the block holder 56. Thus, the block holder 56 may vertically move in a state of being penetrated by the rail cover 59.

A transmission member mounting part 384 on which the power transmission member 52 is mounted may be disposed on the upper left and right side surfaces of the drawer body 38.

The power transmission member 52 may be disposed on the transmission member mounting part 384. The power transmission member 52 may include the drawer shaft 521, the second connection member 522 at the front end of the drawer shaft 521, the transmission gear 523 at the rear end of the drawer shaft 521, and the shaft fixing member allowing the drawer shaft 521 to rotate and fixed to the transmission member mounting part 384.

In detail, the second connection member 522 may be coupled to the front end of the drawer shaft 521, and the second connection member 522 may be exposed to both side surfaces of the front surface of the drawer part 32. Here, the second connection member 522 may be coupled to the first connection member 67 when the front panel door part 31 and the drawer part 32 are coupled as described above. Here, the first connection member 67 and the second connection member 522 may be connected to each other and may rotate together with the driving of the door-side device 41.

Also, the transmission gear 523 may be disposed on the rear end of the drawer shaft 521. The transmission gear 523 may have a bevel gear shape and be coupled to the shaft gear 572 through the rail housing 55. That is, the power transmission member 52 and the elevation shaft 57, which are disposed to perpendicularly cross each other, may be connected to each other by the transmission gear 523 and the shaft gear 572 to transmit the power.

Also, the shaft fixing member 524 may be disposed on the power transmission member 52. The shaft fixing member 524 may be provided on both right and left sides of the drawer part 32. A shaft fixing member 524 may be mounted on the transmission member mounting part 384 to allow the power transmission member 52 to rotate without being tilted or moving.

In the door 30 having the structure described above, the front panel door part 31 and the drawer part 32 may be coupled to and separated from each other. Here, the power transmission member 52 may be separated from the driving device 41 by manipulating the connection device 60.

Hereinafter, a manipulation state of the connection device will be described in detail with reference to the accompanying drawings.

Figure 18:
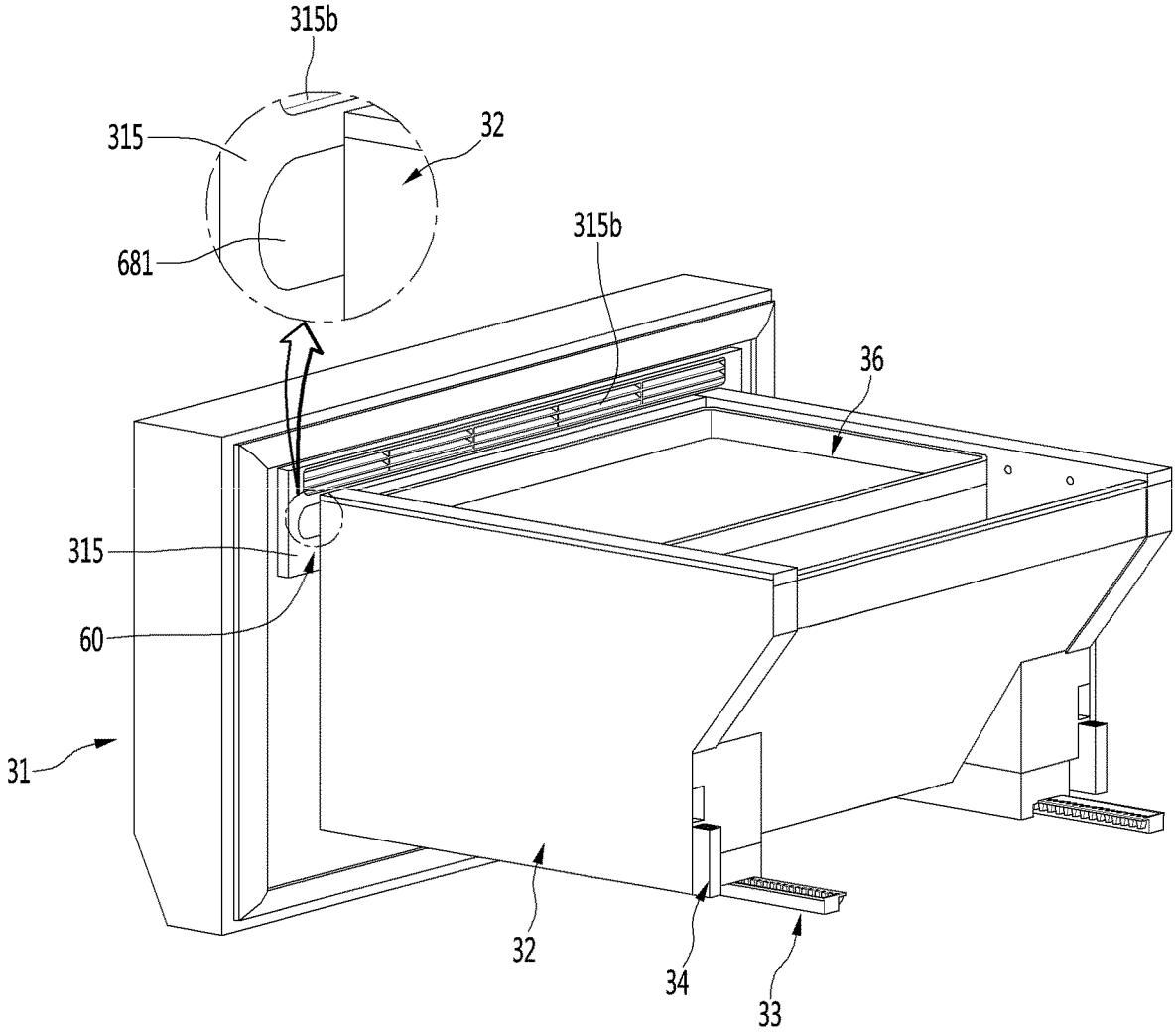
FIG. 18 is a perspective view of the door before the connection device is manipulated.
Figure 19:
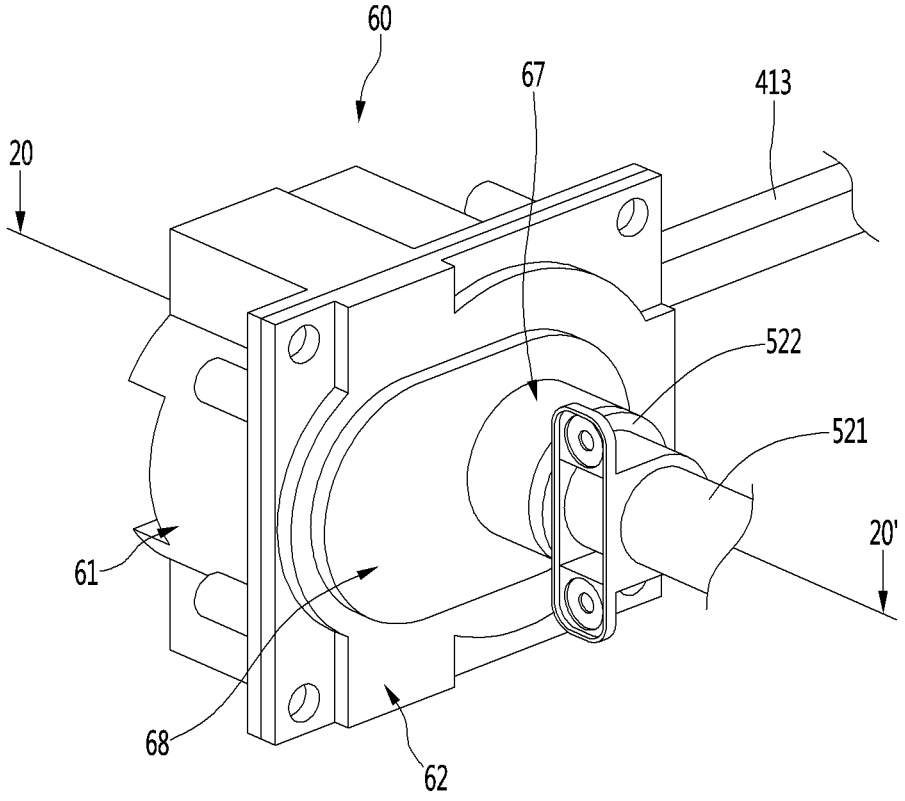
FIG. 19 is a view illustrating a state before the connection device is manipulated.

FIG. 18 is a perspective view of the door before the connection device is manipulated. Also, FIG. 19 is a view illustrating a state before the connection device is manipulated. Also, FIG. 20 is a cross-sectional view of FIG. 19.

As illustrated in the drawings, in the door 30 is in being normally used, as illustrated in FIG. 18, the front panel door part 31 and the drawer part 32 of the door 30 may be in a state of being coupled to each other, the door 30 may be insertable and withdrawable by the user. Also, the door 30 may operate to be inserted and withdrawn by a predetermined distance by the draw-out rail 33 and the draw-out rack 34 and also be inserted and withdrawn by a distance at which the support member inside the drawer part 32 is elevated.

Also, in the state in which the front panel door part 31 and the drawer part 32 are coupled to each other, one side of the door cover 315 and a portion of the connection device 60 may be exposed through the rear surface of the front panel door part 31 or a space between the front panel door part 31 and the drawer part 32. At least a portion of the push member 68 for the user's manipulation may be disposed on one side of the front panel door part 31 exposed between the front panel door part 31 and the drawer part 32 or to the outside of the drawer part 32 so as to be manipulated by the user.

Also, the push member 68 may be disposed so as to be exposed through the outer surface of the door cover 315 in the state of protruding to the outside of the connection device cover 62. Thus, the user may confirm the coupled state of the first connection member 67 and the second connection member 522 through the protruding state of the push member 68.

Also, the elastic member 66 in the connection device 60 may be in the state in which both ends thereof support the second connection gear 64 and the first connection member 67. If the external force due to the user's manipulation is not applied, the coupled state of the second connection gear 64 and the first connection gear 414 may be maintained, and the first connection member 67 may be in the state of being coupled to the second connection member 522.

When the first connection gear 414 rotates by the rotation of the driving shaft 413, the second connection gear 64 may rotate by being interlocked with the rotation of the driving shaft 413, and the first connection member 67 coupled to the second connection gear 64 and the second connection member 522 coupled to the first connection member 67 may rotate together. That is, the power of the driving device 41 may be transmitted to the power transmission member 52 through the connection device 60 to eventually become a state that is capable of being transmitted to the elevation device 51.

In this state, the user may input an operation for manipulating the elevation device 51, and the elevation of the support member 35 in the drawer part 32 may be performed.

The drawer part 32 and the front panel door part 31 may be separated from each other when abnormality of the driving device 41 occurs, or cleaning of the drawer part 32 or maintenance of the entire elevation assembly 40 is required. Here, the connection device 60 may be manipulated.

Figure 21:
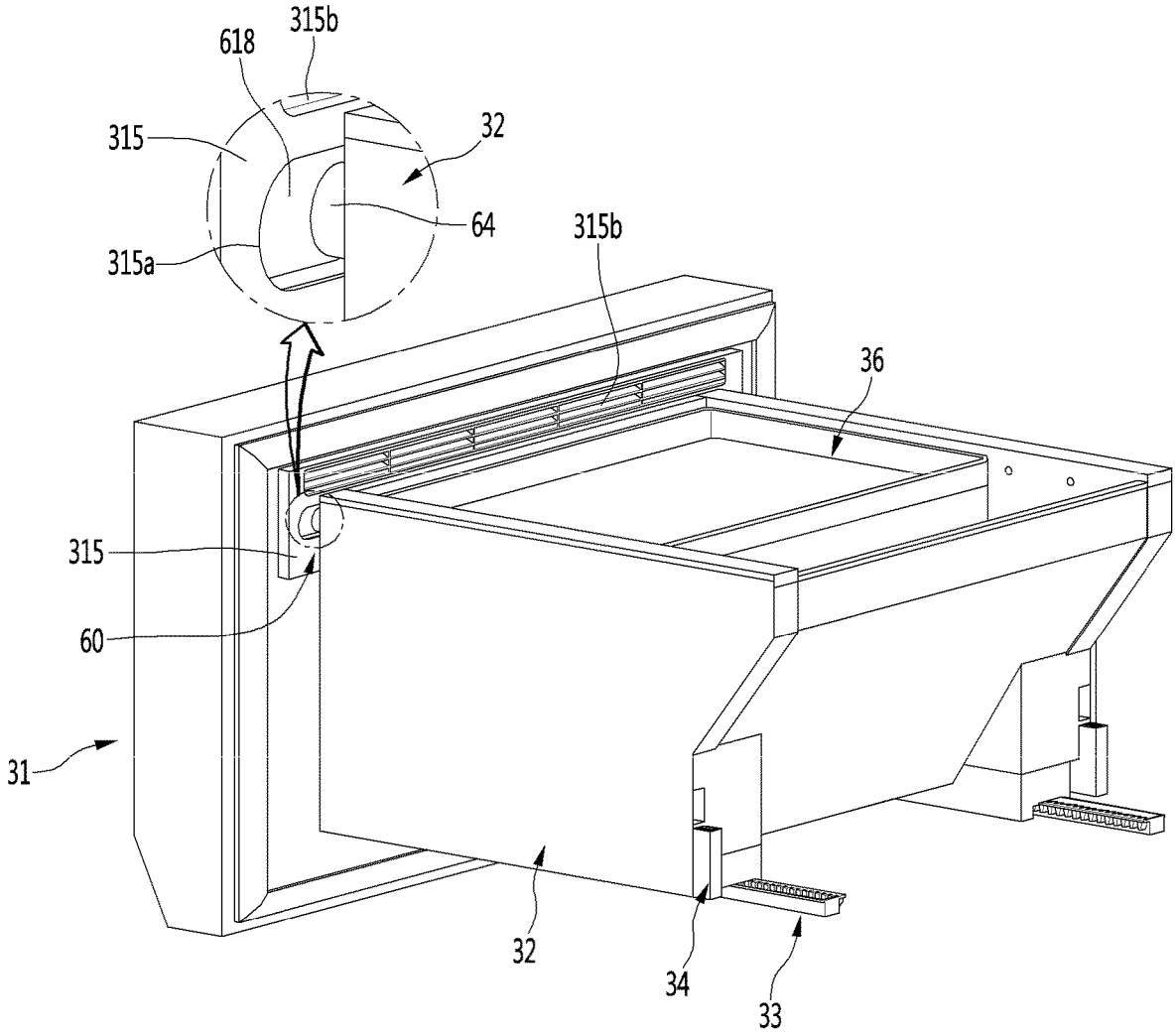
FIG. 21 is a perspective view of the door during the manipulation of the connection device.
Figure 22:
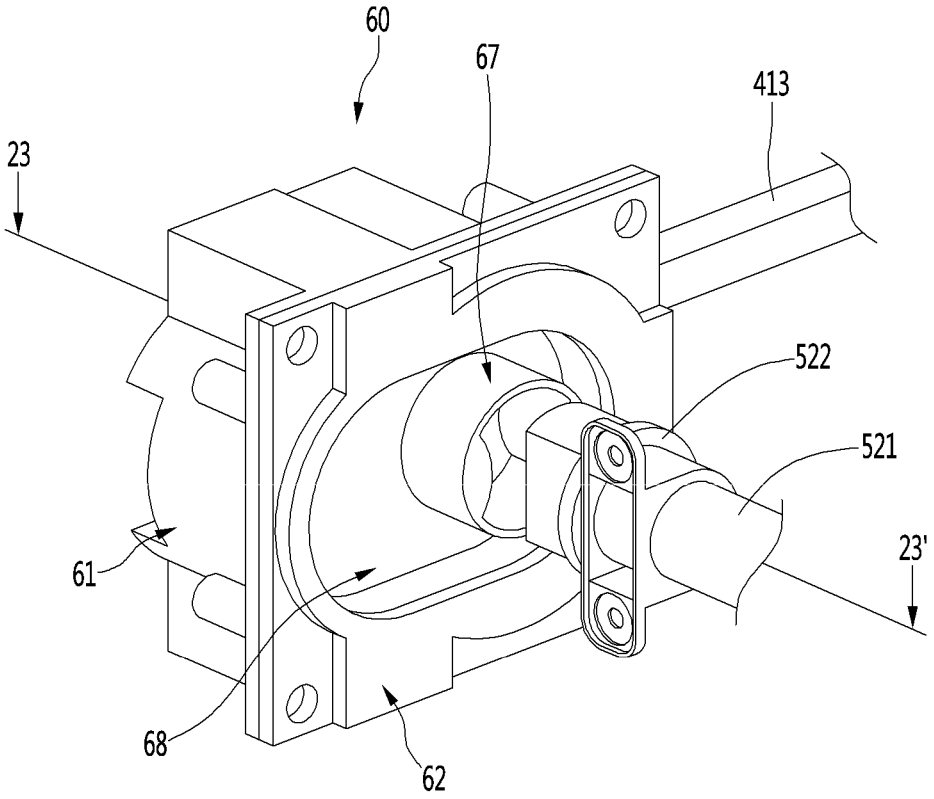
FIG. 22 is a view illustrating a state during the manipulation of the connection device.

FIG. 21 is a perspective view of the door during the manipulation of the connection device. Also, FIG. 22 is a view illustrating a communication state between the refrigerator and an oven. Also, FIG. 23 is a cross-sectional view of FIG. 22.

As illustrated in the drawings, the connection device 60 may be manipulated to separate the front panel door part 31 and the drawer part 32 from each other. Of course, if there is another structure for restricting the front panel door part 31 and the drawer part 32 before the manipulation of the connection device 60, an operation of releasing the restriction before and after the manipulation of the connection device 60 may be additionally performed.

For example, when the door frame 316 is coupled to the drawer part 32, the drawer part 32 and the door frame 316 may be separated from each other, and then the front panel door part 31 may be manipulated by manipulating the connection device 60 to completely separating the front panel door part 31 and the drawer part 32 from each other. Simultaneously, the elevation assembly 40 may also separate the door-side device 41 provided in the front panel door part 31 and the drawer-side device 50 disposed in the drawer part 32 from each other.

The user may press the push member 68 on both sides exposed through the rear surface of the front panel door part 31 as shown in F21. 21 and press the push member 68 to push the elastic member 66, and the first connection member 67 may move together with the push member 68 to the inside of the connection device 60.

Here, the first connection member 67 may move along the coupling member 65, and the first connection part 673 and the second connection part 522*a* may be completely separated from each other by the movement of the first connection member 67 as illustrated in FIGS. 22 and 23, and the first connection member 67 and the power transmission member 52 may be completely separated from each other.

The front panel door part 31 and the drawer part 32 may be separated from each other through the above-described manipulation, and the user may clean or service the drawer part 32. Particularly, the front panel door part 31 and the drawer part 32 may be separated from each other, and all the structures of the elevation assembly 40 may be disposed inside the front panel door part 31. Thus, only the mechanical constituents which operate when the power is supplied may be disposed in the drawer part 32.

Thus, the user may prevent electric shock by the electric device in the state in which the front panel door part and the drawer part 32 are separated from each other and prevent the electric device from being damaged during the cleaning. In addition, there is an advantage that only the front panel door part 31 is separated and serviced when the electric device fails.

The front panel door part 31 and the drawer part 32 may be coupled to each other when the front panel door part 31 and the drawer part 32 are separated from each other. Here, the first connection part 673 and the second connection part 522*a* may be aligned by the coupling of the door frame 316 and the drawer part 32. When the front panel door part 31 and the drawer part 32 are coupled to each other, the connection device 60 and the power transmission member 52 may be connected to each other without performing a separate manipulation process.

That is, the connection device 60 and the power transmission member 52 may be in the state as shown in FIGS. 18 to 20 according to the assembly of the front panel door part 31 and the drawer part 32.

Hereinafter, a state in which the drawer door 30 of the refrigerator 1 is inserted and withdrawn and is elevated according to an embodiment will be described in more detail with reference to the accompanying drawings.

Figure 24:
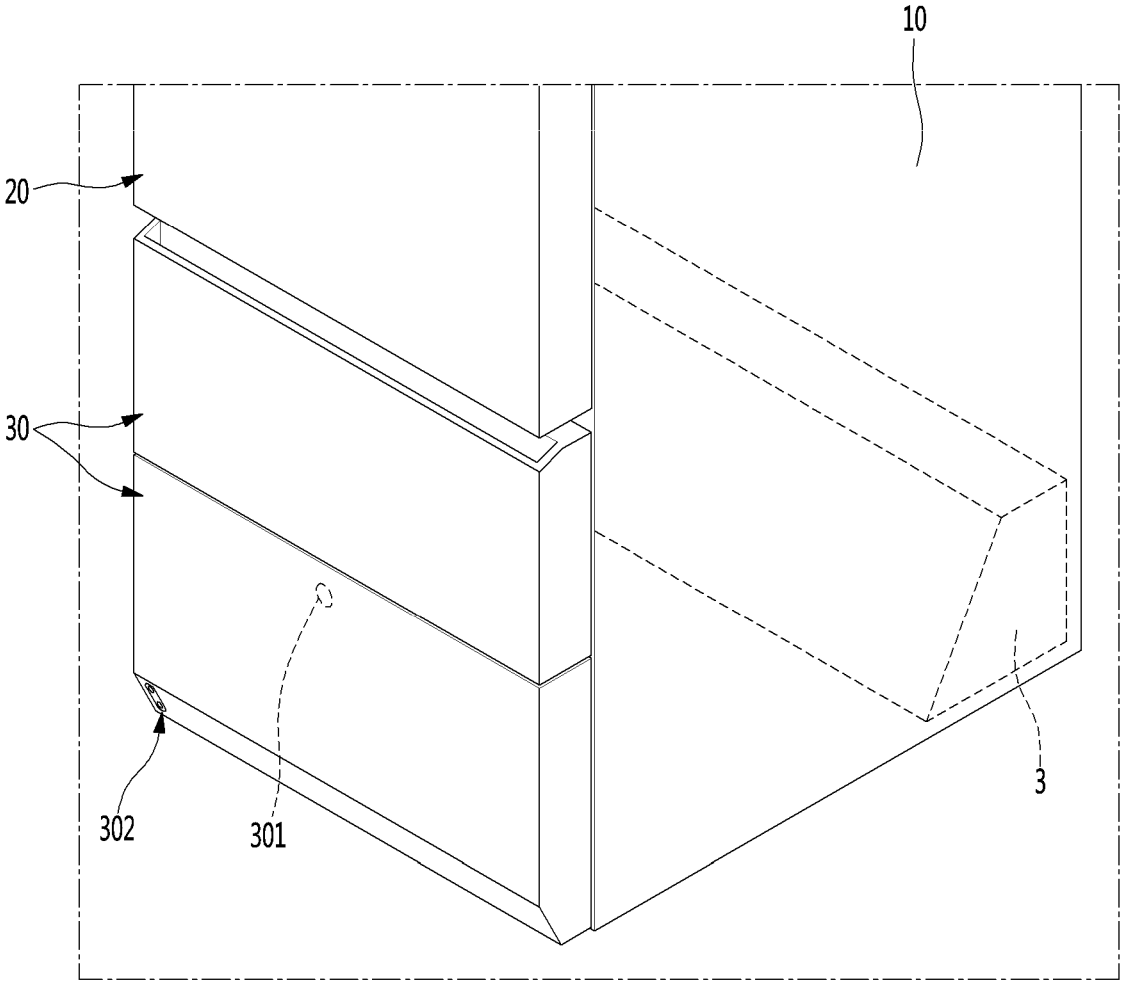
FIG. 24 is a perspective view illustrating a state in which the drawer door is closed.

FIG. 24 is a perspective view illustrating a state in which the drawer door is closed.

As illustrated in the drawing, in the state in which the food is stored, the refrigerator 1 may be maintained in a state in which all of the rotation door 20 and the drawer door 30 are closed. In this state, the user may withdraw the drawer door 30 to accommodate the food.

The drawer door 30 may be provided in plurality in a vertical direction and be withdrawn to be opened by the user's manipulation. Here, the user's manipulation may be performed by touching the manipulation part 301 disposed on the front surface of the rotation door 20 or the drawer door 30. Alternatively, an opening command may be inputted on the manipulation device 302 provided on the lower end of the drawer door 30. Also, the manipulation part 301 and the manipulation device 302 may individually manipulate the insertion and withdrawal of the drawer door 30 and the elevation of the support member 35. Alternatively, the user may hold a handle of the drawer door 30 to open the drawer door 30.

Hereinafter, although the lowermost drawer door 30 of the drawer doors 30, which are disposed in the vertical direction, is opened and elevated as an example, all of the upper and lower drawer doors 30 may be inserted and withdrawn and elevated in the same manner.

Figure 25:
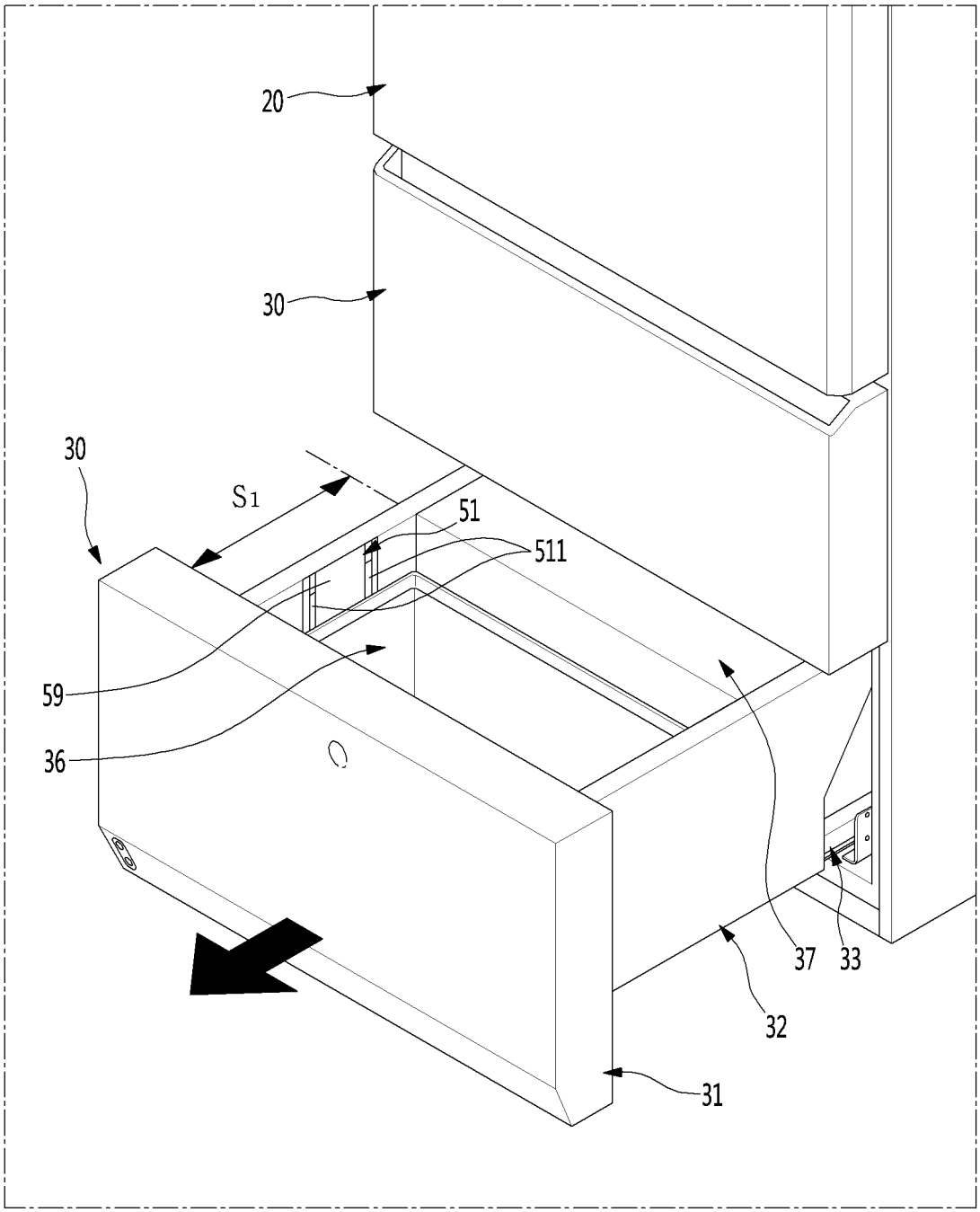
FIG. 25 is a perspective view illustrating a state in which the drawer door is completely opened.
Figure 26:
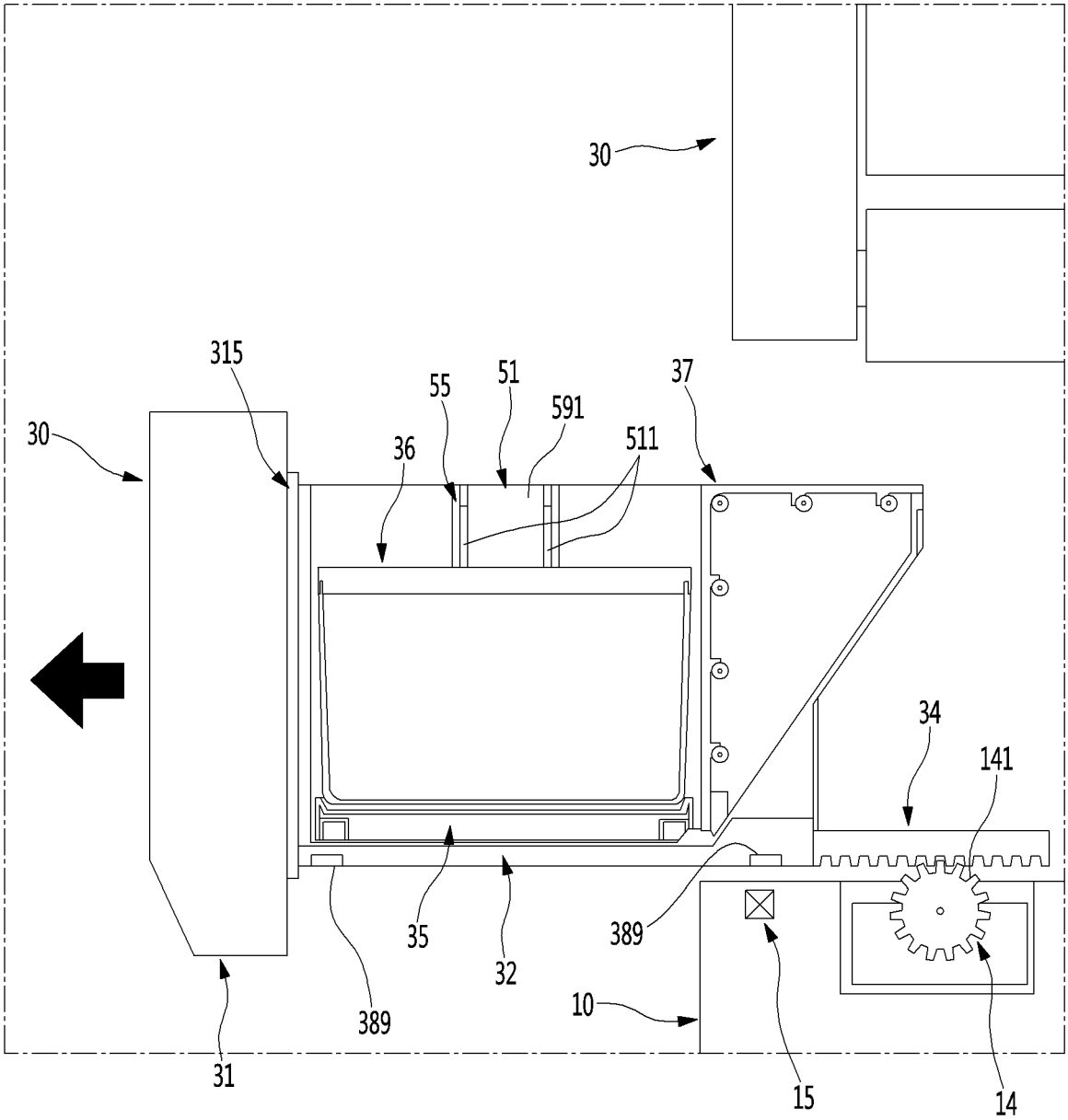
FIG. 26 is a cross-sectional view of the drawer door in the state of FIG. 25.

FIG. 25 is a perspective view illustrating a state in which the drawer door is completely opened. FIG. 26 is a cross-sectional view of the drawer door in the state of FIG. 25.

As illustrated in the drawings, the user may manipulate the draw-out operation on the drawer door 30 to withdraw the drawer door 30 forward. The drawer door 30 may be withdrawn while the draw-out rail 33 extends.

The drawer door 30 may be configured to be inserted and withdrawn by the driving of the draw-out motor 14, not by a method of directly pulling the drawer door 30 by the user. The draw-out rack 34 provided on the bottom surface of the drawer door 30 may be coupled to the pinion gear 141 rotating when the draw-out motor 14 provided in the cabinet 10 is driven. Thus, the drawer door 30 may be inserted and withdrawn according to the driving of the draw-out motor 14.

The draw-out distance of the drawer door 30 may correspond to a distance at which the front space S1 within the drawer part 32 is completely exposed to the outside. Thus, in this state, the support member 35 may not interfere with the doors 20 and 30 disposed thereabove or the cabinet 10.

Here, the draw-out distance of the drawer door 30 may be determined by a draw-out detection device 15 disposed on the cabinet 10 and/or the drawer door 30. The draw-out detection device 15 may be provided as a detection sensor that detects a magnet 389 to detect a state in which the drawer door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the drawer door 30 is closed and a position of the magnet 389 when the drawer door 30 is completely withdrawn. Thus, the draw-out state of the drawer door 30 may be determined by the draw-out detection device 15.

Also, as necessary, a switch may be provided at each of positions at which the drawer door 30 is completely inserted and withdrawn to detect the draw-out state of the drawer door 30. In addition, the draw-out state of the drawer door 30 may be detected by counting the rotation number of draw-out motor 14 or measuring a distance between the rear surface of the front panel door part 31 and the front end of the cabinet 10.

In the state in which the drawer door 30 is completely withdrawn, the driving motor 411 may be driven to elevate the support member 35. The support member 35 may be driven in an even situation in which the drawer door 30 is sufficiently withdrawn to secure safe elevation of the food or container 36 seated on the support member 35.

That is, in the state in which the drawer door 30 is withdrawn to completely expose the front space to the outside, the support member 35 may ascend to prevent the container 36 or the stored food seated on the support member 35 from interfering with the doors 20 and 30 or the cabinet 10.

The ascending of the support member 35 may start in a state in which the drawer door 30 is completely withdrawn. Also, to secure the user's safety and prevent the food from being damaged, the ascending of the support member 35 may start after a set time elapses after the drawer door 30 is completely withdrawn.

After the drawer door 30 is completely withdrawn, the user may manipulate the manipulation part 301 to input the ascending of the support member 35. That is, the manipulation part 301 may be manipulated to withdraw the drawer door 30, and the manipulation part 301 may be manipulated again to elevate the support member 35. Also, the drawer door 30 may be manually inserted and withdrawn by a user's hand. After the drawer door 30 is withdrawn, the manipulation part 301 is manipulated to elevate the support member 35.

Figure 27:
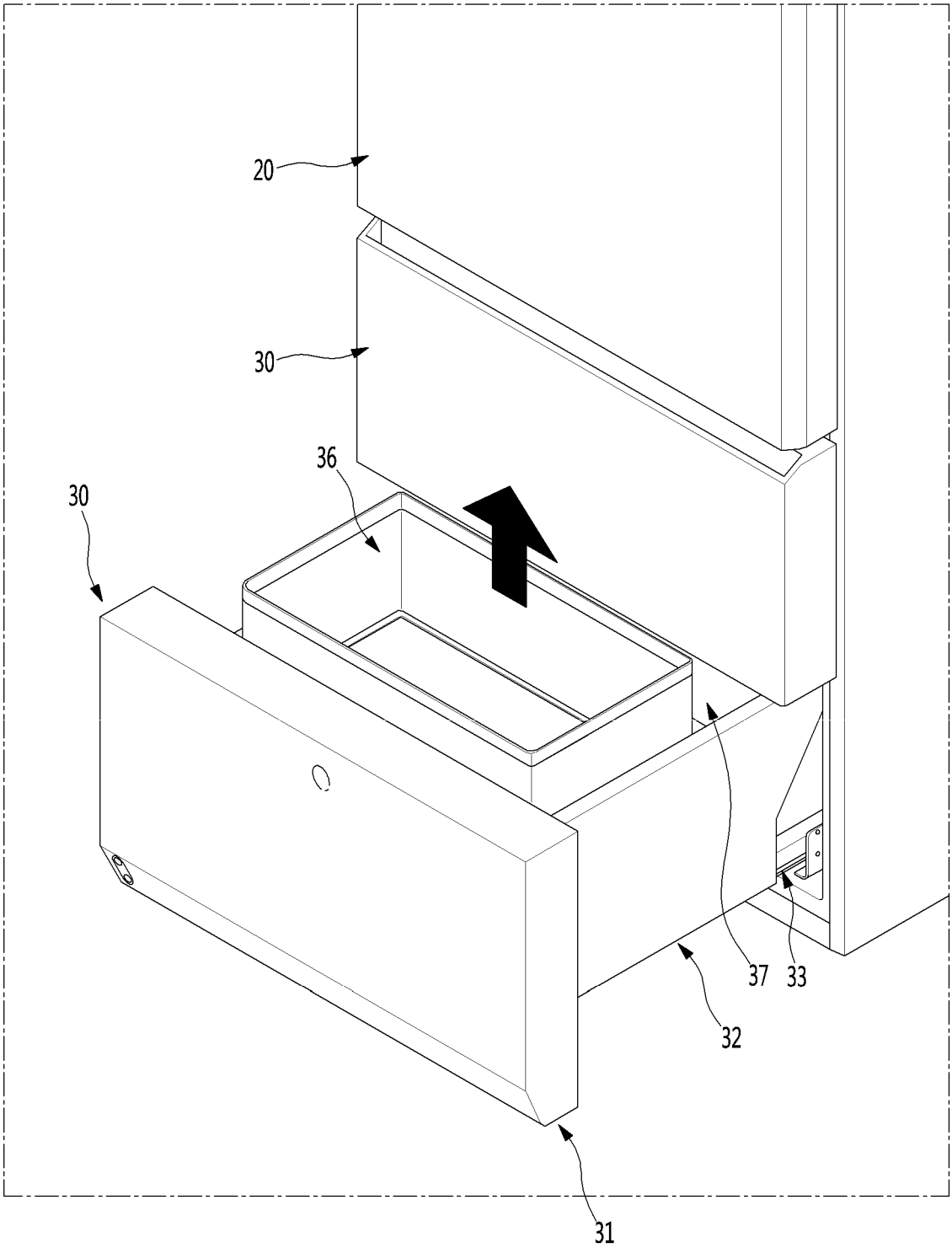
FIG. 27 is a perspective view illustrating a state in which the support member of the drawer door is completely elevated.
Figure 28:
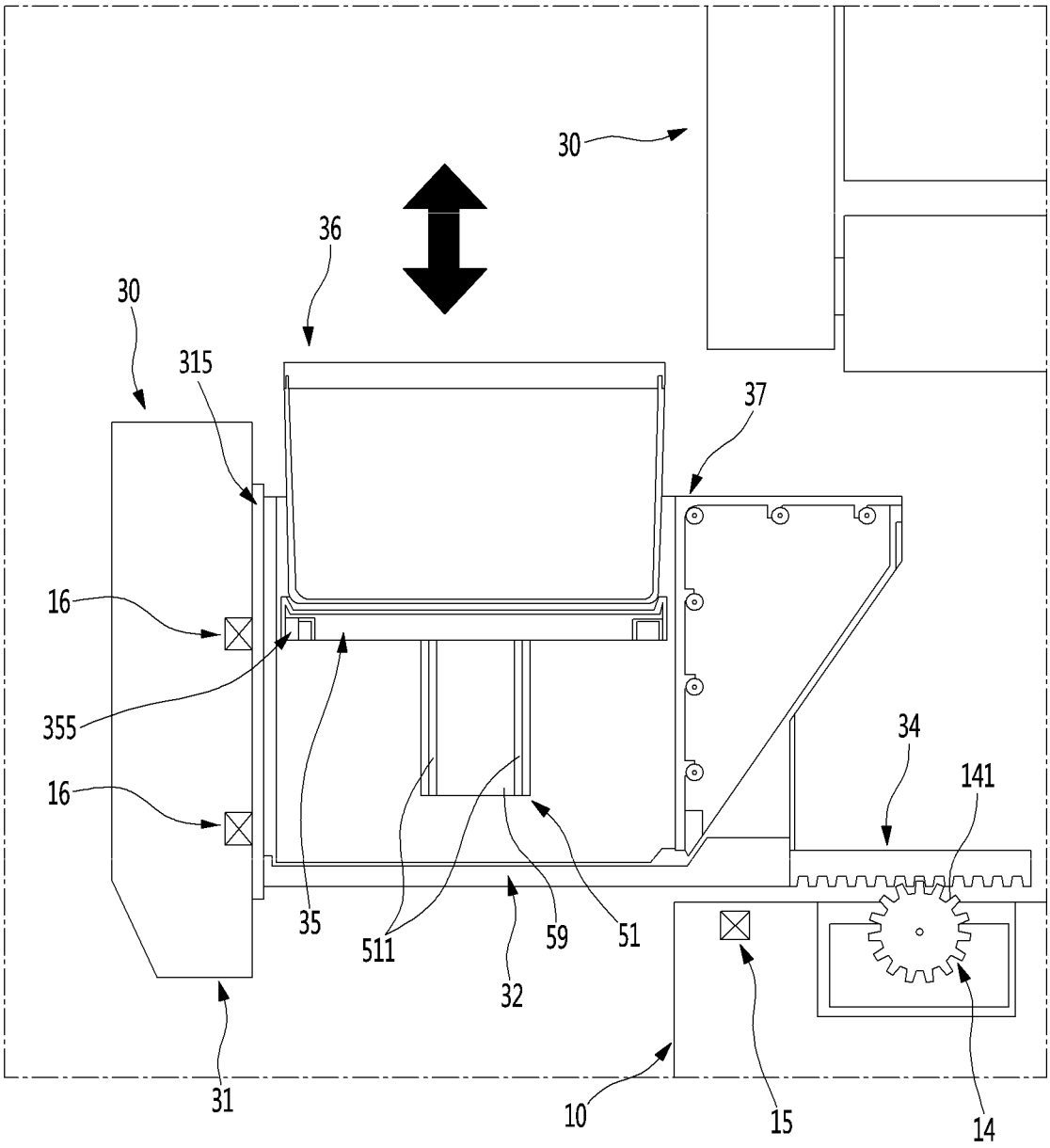
FIG. 28 is a cross-sectional view of the drawer door in the state of FIG. 27.

FIG. 27 is a perspective view illustrating a state in which the support member of the drawer door is completely elevated. FIG. 28 is a cross-sectional view of the drawer door in the state of FIG. 27.

In the state of FIGS. 27 and 28, the elevation of the support member 35 may be performed in the state in which the drawer door 30 is withdrawn. The support member 35 may be elevated by the operation of the driving motor 411. In the state in which the door-side device 40 of the front panel door part 31 and the drawer-side device 50 of the drawer part 32 are coupled to each other, the power may be transmitted to elevate the support member 35.

In more detail, when the driving motor 411 operates, the driving shafts 413 connected to the driving motor 411 may rotate, and also the first gear 414 and the second gear 415 connected to the driving shaft 413 may rotate.

The rotation force of the driving device 41 may be transmitted to the drawer-side device 50 by connection device 60 and the second member 522, which are coupled to each other. Thus, the rotation force transmitted from the driving device 41 may allow the power transmission member 52 and the transmission gear 523 of the end of the power transmission member 52 to rotate.

The rotation force may be transmitted in the state in which the transmission gear 523 and the shaft gear 572 are connected to each other, and the rotation force of the power transmission member 52 may allow the elevation shaft 57 to rotate. Due to the rotation of the elevation shaft 57, the elevation block 567 and the block holder 56 may move upward along the elevation shaft 57. Here, all of the portions of the elevation device 51, which is exposed to the inside of the drawer part 32, may be covered by the rail cover 59. Also, the block holder 56 may vertically move along the guide slit 511 defined by the rail cover 59.

Here, the block holder 56 may vertically move together with the connecting bracket 54 in the state of being coupled to the connecting bracket 54 so as to be stably elevated without being tilted.

The support member 35 may continuously ascend by a sufficient height so that the user is accessible to the food or container 36 seated on the support member 35. Thus, the user may easily lift the food or container.

The support member 35 may ascend until the block holder 56 is disposed at the upper end of the guide slit. When the ascending of the support member 35 is completed, the driving of the driving motor 411 is stopped.

When an ascending completion signal is inputted, the driving of the driving motor 411 may be stopped. For this, a height detection device 16 for detecting a position of the support member 35 may be provided. The height detection device 16 may be provided in the front panel door part 31 at a height corresponding to the uppermost ascending position of the support member 35 and the lowermost descending position of the support member 35.

The height detection device 16 may be provided as a detection sensor that detects a magnet 355. The height detection device 16 may detect the magnet 355 disposed on the support member 35 to determine whether the ascending of the support member 35 is completed. Also, the height detection device 16 may be provided as a switch structure to turn on the switch when the support member 35 maximally ascends. Also, the height detection device 16 may be provided on the elevation rail 44 or the elevation shaft 57 to detect the maximally ascending position of the support member 35. Also, whether the support member 35 maximally ascends may be determined according to a variation in load applied to the driving motor 411.

The driving of the driving motor 411 is stopped in the state in which the support member 35 maximally ascends. In this state, although the support member 35 is disposed inside the drawer part 32, the food or container 36 seated on the support member 35 may be disposed at a position higher than the opened top surface of the drawer part 32. Thus, the user may easily access the food or container 36. Particularly, it is not necessary to allow the waist excessively for lifting the container 36, so that it is possible to perform safer and more convenient operation.

After the user's food storing operation is completed, the user may allow the support member 35 to descend by manipulating the manipulation part 301. The descending of the support member 35 may be performed by reverse rotation of the driving motor 411 and may be gradually performed through the reverse procedure with respect to the above-described procedure.

Also, when the descending of the support member 35 is completed, i.e., in the state of FIGS. 25 and 26, the completion of the descending of the support member 35 may be performed by the height detection device 16. The height detection device 16 may be further provided at a position that detects the magnet disposed on the support member 35 when the support member 35 is disposed at the lowermost descending position. Thus, when the completion of the descending of the support member 35 is detected, the driving of the driving motor 411 is stopped.

Also, after the driving of the driving motor 411 is stopped, the drawer door 30 may be inserted. Here, the drawer door 30 may be closed by the user's manipulation or by the driving of the draw-out motor 14. When the drawer door 30 is completely closed, a state of FIG. 16 may become.

In addition to the foregoing embodiment, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Figure 29:
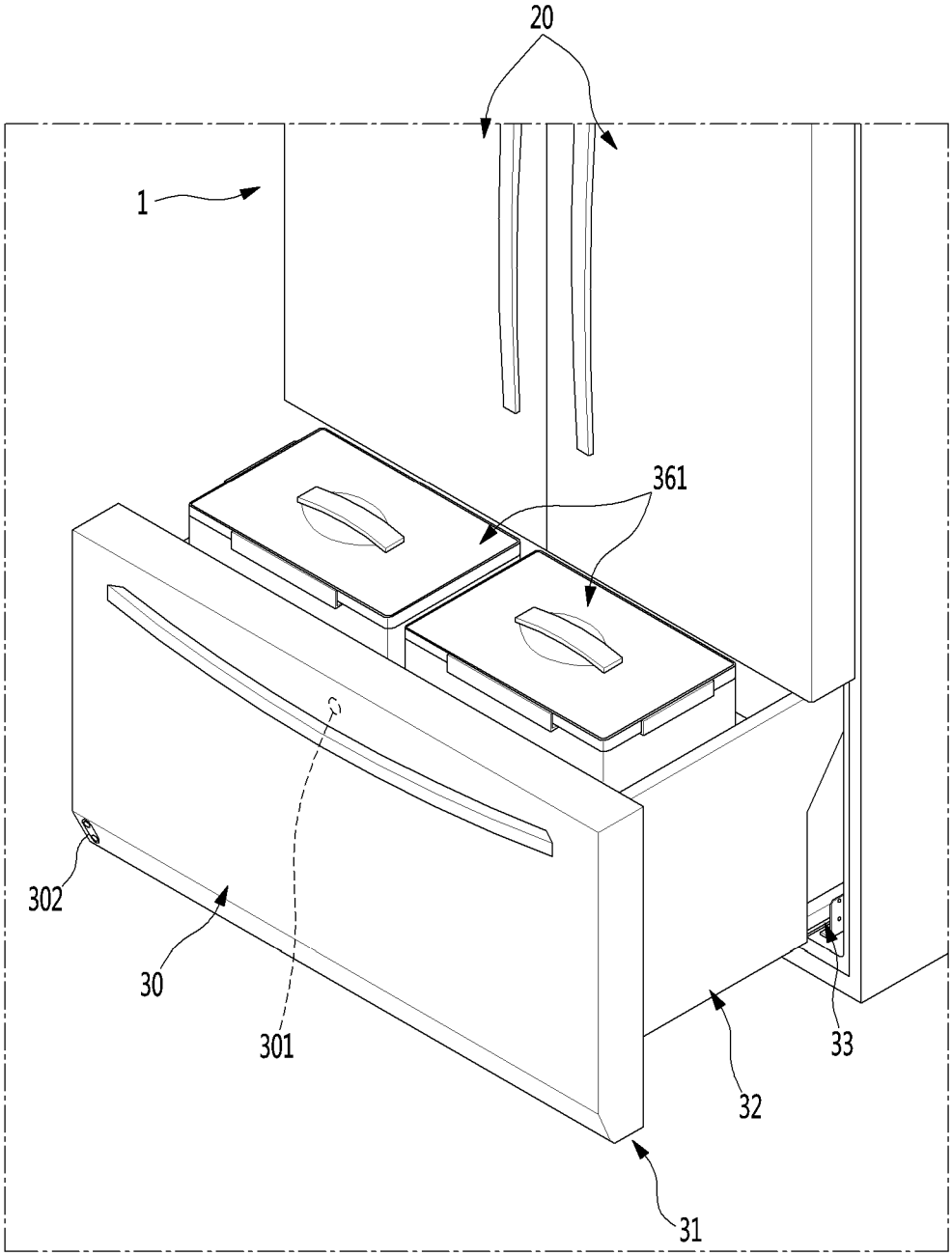
FIG. 29 is a perspective view of a refrigerator according to another embodiment.

FIG. 29 is a perspective view of a refrigerator according to another embodiment.

As illustrated in the drawing, a refrigerator 1 according to another embodiment may include a cabinet 10 having a storage space that is vertically partitioned and a door 2 opening and closing the storage space.

The door 2 may include a pair of rotation doors 20 which are provided in an upper portion of a front surface of the cabinet 10 to open and close an upper storage space and a drawer door 30 disposed in a lower portion of the front surface of the cabinet 10 to open and close a lower storage space. The drawer door 30 may be inserted and withdrawn forward and backward like the foregoing embodiment. In the state in which the drawer door 30 is withdrawn, the support member 35 within the drawer door 30 may be vertically elevated.

A manipulation part 301 or a manipulation device 302 may be provided at one side of the front panel door part 31. The insertion and withdrawal of the drawer door 30 and/or the elevation of the support member 35 may be realized by manipulating the manipulation part 301 or the manipulation device 302.

The support member 35 may be provided in the drawer part 32. The support member 35 may be elevated by driving the elevation assembly provided in the front panel door part 31 and the drawer part 32. Since the structure of the drawer door 30 and the structure of the elevation assembly 40 are the same as those according to the foregoing embodiment, their detailed descriptions will be omitted.

A plurality of containers 361 may be provided in the support member 35. The container 361 may be a sealed container such as a kimchi passage, and a plurality of the containers 361 may be seated on the support member 35. The container 361 may be elevated together with the support member 35 when the support member 35 is elevated. Thus, in the state in which the container 361 ascends, at least a portion of the drawer part 32 may protrude, and thus, the user may easily lift the container 361.

The support member 35 may interfere with the rotation door 20 in the rotation door 20 is opened even though the drawer door 30 is withdrawn. Thus, the support member 35 may ascend in a state in which the rotation door 20 is closed. For this, a door switch for detecting the opening/closing of the rotation door 20 may be further provided.

Figure 30:
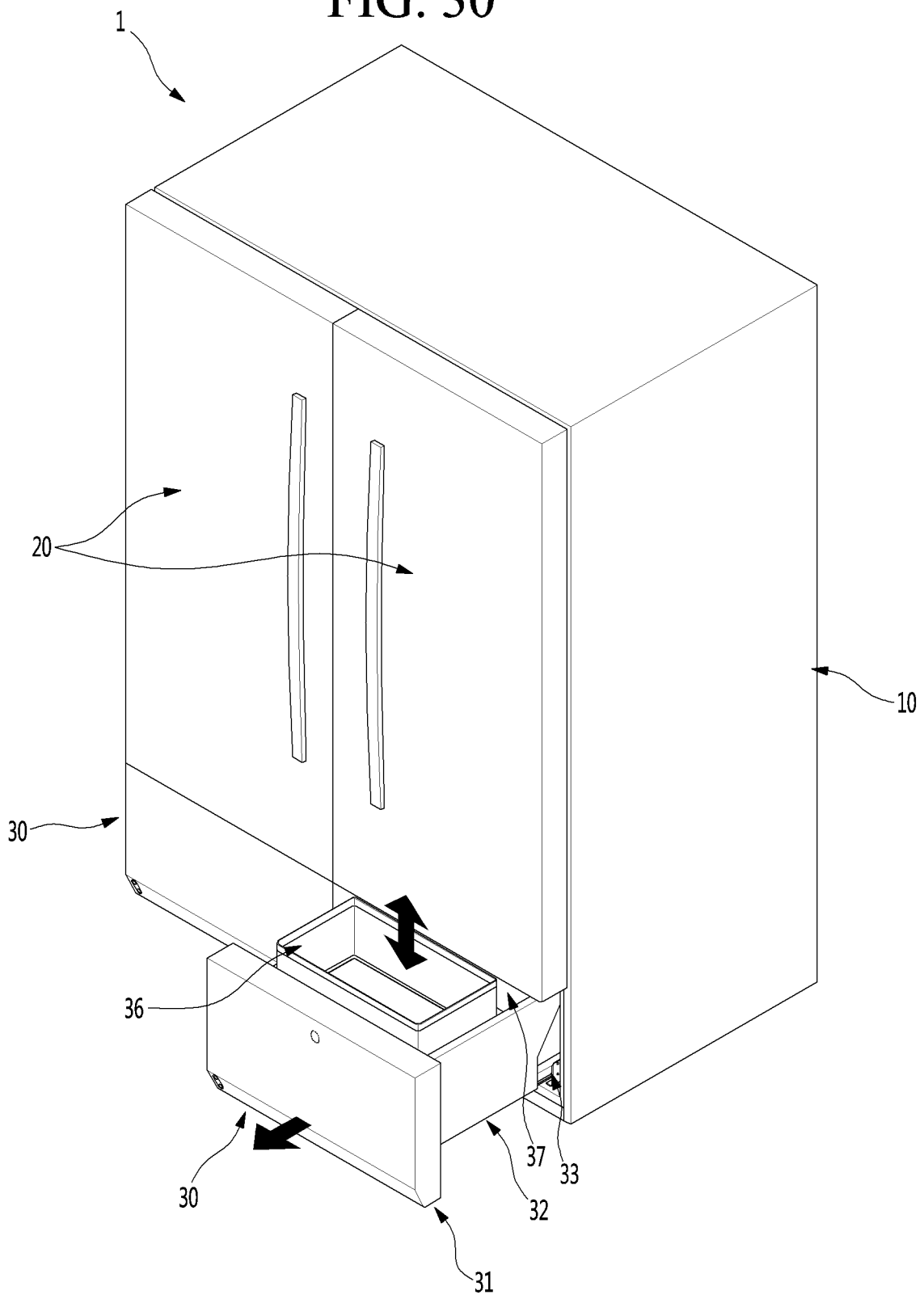
FIG. 30 is a perspective view of a refrigerator according to another embodiment.

FIG. 30 is a perspective view of a refrigerator according to another embodiment.

As illustrated in the drawings, a refrigerator 1 according to another embodiment includes a cabinet 10 defining a storage space therein and a door 2 opening and closing an opened front surface of the cabinet 10, which define an outer appearance of the refrigerator 1.

The inside of the cabinet 10 may be divided into an upper space and a lower space. If necessary, the upper and lower storage spaces may be divided again into left and right spaces.

The door 2 may include a rotation door 20 which is provided in an upper portion of the cabinet 10 to open and close the upper storage space and a drawer door 2 disposed in a lower portion of the cabinet 10 to open and close the lower storage space.

Also, the lower space of the cabinet may be divided into left and right spaces. The drawer door 30 may be provided in a pair so that the pair of drawer doors 30 respectively open and close the lower spaces. The pair of drawer doors 30 may be disposed in parallel to each other at left and right sides. The drawer doors 30 may have the same structure.

The drawer door 30 may have the same structure as the drawer door according to the foregoing embodiment. Thus, the drawer door 30 may be inserted and withdrawn by user's manipulation. In the drawer door 30 is withdrawn, the support member 35 may ascend so that a user more easily accesses a food or container within the drawer door 30.

The following effects may be expected in the refrigerator according to the proposed embodiments.

The refrigerator according to the embodiment, the portion of the storage space within the drawer door may be elevated in the state in which the drawer door is withdrawn. Thus, when the food is accommodated in the drawer door disposed at the lower side, the user may not excessively turn its back to improve the convenience in use.

Also, the support member on which the food or the container is seated may be disposed in the drawer door, and the elevation assembly may be provided on both the sides of the drawer door to elevate the support member. Thus, the support member may be elevated in the state in which both ends of the support member are supported. Thus, the support member may be prevented from being eccentric or tilted to secure the stable elevation and the operation reliability.

Also, the support member may constitute a portion of the space within the drawer part and be disposed in the front space of the drawer part to elevate the support member in the state in which the drawer part is withdrawn so that only the front space is disposed to the outside without withdrawing the entire drawer part. Thus, the instability due to the excessive withdrawal of the drawer part may be solved, and the additional constituent for supporting the load may be unnecessary, and also, the loss of the cold air to the outside due to the withdrawal of the entire drawer part may be prevented.

Also, the drawer door may include the front panel door part defining the front surface of the door and the drawer part defining the accommodation space, and the front panel door part and the drawer part may be coupled to be separated from each other.

Also, the elevation assembly may include the door-side device provided in the front panel door part and the drawer-side device provided in the drawer part. When the front panel door part and the drawer part are coupled to each other, the door-side device and the drawer-side device may be connected to each other to transmit the power. Thus, the assemblability and the service performance of the drawer door may be improved.

Also, in the front panel door part and the drawer part are coupled to each other, the connection device on the rear surface of the door may be manipulated to simply separate the driving device of the front panel door part from the elevation device of the drawer part, and the driving device and the elevation device may be separated from each other through the simple manipulation without using the separate mechanism or performing the separate separation process. Furthermore, the front panel door part and the drawer part may be easily separated from each other.

Also, the electrical device, to which the power is supplied, such as the elevation motor may be disposed in the door-side device, and only the mechanism-side of the drawer-side device may be disposed to secure the user's safety. Also, the separation of the drawer par and the arrangement of the electrical device may be performed on the drawer part to improve the cleanability of the drawer part.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines an upper storage space and a lower storage space;

a front panel door part configured to open and close at least a portion of the lower storage space;

a drawer part located rearward of a rear surface of the front panel door part and configured to insert into and withdraw from the lower storage space together with the front panel door part;

an elevation device that is located inside of the drawer part and that is configured to elevate an object stored in the drawer part relative to a bottom surface of the drawer part;

a driving device that is located at the front panel door part and that is configured to provide power for operation of the elevation device;

a power transmission member that is disposed at the drawer part, that is coupled to the elevation device, and that is configured to transmit the power from the driving device; and a connection device that is movably disposed at the front panel door part and that is configured to detachably couple the driving device to the power transmission member, wherein the connection device is exposed to a rear side of the front panel door part and configured to be manipulated and moved by a hand of a user, the connection device being detachably connected to an end of the power transmission member that is exposed to a front side of the drawer part, and wherein the connection device is configured to, based on a manipulation of the connection device by the user, couple and decouple the driving device and the power transmission member in a state in which the front panel door part is coupled to the drawer part.

2. The refrigerator according to claim 1, wherein the rear surface of the front panel door part defines a recess that accommodates the driving device.

3. The refrigerator according to claim 2, wherein the front panel door part comprises a door cover that covers the recess and the driving device.

4. The refrigerator according to claim 3, wherein the door cover defines an opening that exposes a portion of the connection device, the portion being configured to be manipulated and moved by the hand of the user.

5. The refrigerator according to claim 1, wherein the connection device is covered by the rear surface of the front panel door part, and wherein the rear surface of the front panel door part has an opening that exposes a portion of the connection device, the portion being configured to be manipulated and moved by the hand of the user.

6. The refrigerator according to claim 1, wherein the driving device comprises a first connection gear that is disposed in the front panel door part and that is connected to the connection device, and wherein the connection device further comprises:

a connection device case located at the front panel door part;

a second connection gear that is accommodated in the connection device case and that is coupled to the first connection gear of the driving device, the second connection gear being configured to rotate about an axis of the second connection gear;

a first connection member that extends toward the power transmission member and that is configured to connect to the power transmission member; and an elastic member that is disposed between the second connection gear and the first connection member.

7. The refrigerator according to claim 6, wherein the first connection member extends along the axis of the second connection gear and is connected to the second connection gear, the first connection member being configured to rotate together with the second connection gear and selectively couple the driving device to the power transmission member to transmit power from the driving device to the power transmission member, and wherein the first connection member is further configured to:

insert into the connection device case while compressing the elastic member; and disconnect from the elevation device in a state in which the first connection member is inserted into the connection device case.

8. The refrigerator according to claim 7, wherein the connection device includes an exposed portion that is exposed to a space between the rear surface of the front panel door part and a front surface of the drawer part, wherein the exposed portion comprises a push member that is exposed through the rear surface of the front panel door part and that is configured to be manipulated by the user, and wherein the push member is connected to the first connection member and is configured to move together with the first connection member based on the push member being manipulated by the user.

9. The refrigerator according to claim 8, wherein the first connection member is in surface contact with the push member and is configured to insert into the connection device case based on the push member being pushed toward the front panel door part.

10. The refrigerator according to claim 8, wherein the push member comprises a push part that protrudes toward the drawer part and that is configured to be manipulated by the user, the push part defining a through-hole that faces the drawer part and that receives the first connection member.

11. The refrigerator according to claim 8, wherein the connection device further comprises a coupling member that is configured to connect the second connection gear to the first connection member and that allows the second connection gear and the first connection member to rotate together with each other, and wherein the first connection member defines an insertion hole that receives the coupling member, the first connection member being configured to move along the coupling member based on the push member being pushed toward the connection device case.

12. The refrigerator according to claim 11, wherein the elastic member surrounds the coupling member.

13. The refrigerator according to claim 6, wherein the first connection member comprises a first connection part that is located at an end of the first connection member and that is configured to connect to the power transmission member, wherein the first connection part defines an insertion hole that is configured to couple to an end of the power transmission member and that has a shape corresponding to a shape of the end of the power transmission member, and wherein the first connection part is configured to transfer power from the driving device to the elevation device based on the insertion hole of the first connection part coupling to the end of the elevation device.

14. The refrigerator according to claim 13, wherein the connection device further comprises a coupling member that passes through the insertion hole of the first connection part and that is configured to connect the first connection member to the second connection gear.

15. The refrigerator according to claim 1, wherein the connection device comprises:

a connection device case located at the front panel door part;

a connection gear that is accommodated in the connection device case and that is coupled to an end portion of the driving device;

a first connection member that protrudes from the connection device case toward the power transmission member and that is configured to connect to the power transmission member; and an elastic member that is disposed between the connection gear and the first connection member.

16. The refrigerator according to claim 15, wherein the driving device comprises:

a driving shaft that is disposed inside of the front panel door part and that extends across the front panel door part; and a driving gear that is disposed at an end of the driving shaft, that is disposed inside of the connection device case, and that is coupled to the connection gear.

17. The refrigerator according to claim 15, wherein the connection device further comprises:

a push member that is exposed through the rear surface of the front panel door part and that is configured to be pushed by the user toward the connection device case, and wherein the push member is connected to the first connection member and is configured to move together with the first connection member.

18. The refrigerator according to claim 17, wherein the first connection member comprises:

a first connection part that protrudes from the connection device case toward the power transmission member and that is configured to connect to the power transmission member; and a support part that extends from a circumference of the first connection part and that is in contact with the push member, and wherein the elastic member is disposed between the connection gear and the support part.

19. The refrigerator according to claim 1, wherein the power transmission member comprises a pair of rods that extend along lateral side surfaces of the drawer part.

20. The refrigerator according to claim 1, wherein the driving device comprises a driving shaft that is disposed inside of the front panel door part and that extends across the front panel door part, and wherein the power transmission member comprises a rod that extends along a lateral side surface of the drawer part in a direction crossing the driving shaft.

* * * * *